US011472586B2

(12) United States Patent
Nishikawa et al.

(10) Patent No.: US 11,472,586 B2
(45) Date of Patent: Oct. 18, 2022

(54) AUTOMATIC INSERTION DEVICE AND AUTOMATIC INSERTION METHOD FOR BACKING-EQUIPPED SHRINK FILM PACKAGING

(71) Applicants: Yoshihide Nishikawa, Osaka (JP); SUN-BRIGHT CO., LTD., Shiojiri (JP)

(72) Inventors: Yoshihide Nishikawa, Osaka (JP); Keiji Kitaguchi, Nakayama (JP); Chihiro Uchiyama, Osaka (JP); Katsuyoshi Okuhara, Nagano (JP)

(73) Assignees: Yoshihide Nishikawa, Osaka (JP); SUN-BRIGHT CO., LTD., Nagano (JP)

( * ) Notice: Subject to any disclaimer, the term of this patent is extended or adjusted under 35 U.S.C. 154(b) by 267 days.

(21) Appl. No.: 16/765,391

(22) PCT Filed: Nov. 12, 2018

(86) PCT No.: PCT/JP2018/041884

§ 371 (c)(1),
(2) Date: May 19, 2020

(87) PCT Pub. No.: WO2019/098160

PCT Pub. Date: May 23, 2019

(65) Prior Publication Data

US 2021/0371145 A1 Dec. 2, 2021

(30) Foreign Application Priority Data

Nov. 19, 2017 (JP) ..... JP2017-222343

(51) Int. Cl.

| | |
|---|---|
| ***B65B 35/18*** | (2006.01) |
| ***B65B 43/36*** | (2006.01) |
| ***B65B 53/00*** | (2006.01) |

(52) U.S. Cl.
CPC ..... *B65B 35/18* (2013.01); *B65B 43/36* (2013.01); *B65B 53/00* (2013.01)

(58) Field of Classification Search
CPC ..... B65B 35/18; B65B 43/36; B65B 43/30; B65B 15/00; B65B 35/20; B65B 53/02; B65B 43/465; B65D 73/00
See application file for complete search history.

(56) References Cited

U.S. PATENT DOCUMENTS 3,470,675 A 10/1969 Crane
4,912,913 A * 4/1990 Rundle ..... B65B 51/065 156/468

(Continued)

FOREIGN PATENT DOCUMENTS

JP S48-021146 6/1973
JP S62-122918 6/1987

(Continued)

OTHER PUBLICATIONS

International Search Report of PCT/JP2018/041884, dated Jan. 22, 2019, 6 pages including English translation.

*Primary Examiner* — Andrew M Tecco
*Assistant Examiner* — Nicholas E Igbokwe
(74) *Attorney, Agent, or Firm* — Hamre, Schumann, Mueller & Larson, P.C.

(57) ABSTRACT

In the present invention, an insertion object (300) and backing-equipped shrink film packaging (200) are lined up in series along the insertion direction. An introduction guide body (120) comprises: a head part (121) having an outer diameter smaller than the inner diameter of the a shrink film (220); and an air-blowing port (122) that blows air from the inside thereof toward the outer surface thereof. There are an insertion preparation means in which the introduction guide body (120) is gradually introduced into the shrink film (220) of the backing-equipped shrink film packaging (200) by the (Continued)

sliding movement of a slider device (130), and the shrink film (220) is inflated by air, and an insertion means in which the insertion object (300) is gradually inserted into the inflated shrink film (220), and the insertion object (300) is pulled or pushed to a prescribed position by the insertion means.

9 Claims, 23 Drawing Sheets

(56) References Cited

U.S. PATENT DOCUMENTS 5,667,071 A * 9/1997 Nakagoshi ..... B65B 9/026 206/455
6,880,313 B1 * 4/2005 Gessford ..... B65D 71/08 53/442
2005/0193693 A1 * 9/2005 Chao ..... B65B 11/10 53/589
2007/0056679 A1 3/2007 Orlandi et al.
2008/0272013 A1 * 11/2008 Hartness ..... B65B 27/04 206/139
2011/0036055 A1 * 2/2011 Shibagaki ..... B65B 43/30 53/266.1

FOREIGN PATENT DOCUMENTS

| | | |
|---|---|---|
| JP | H11-148051 | 6/1999 |
| JP | 2009-012781 | 1/2009 |
| JP | 2009-509871 | 3/2009 |
| JP | 2011-136772 | 7/2011 |
| JP | 2012-188127 | 10/2012 |
| JP | 2012-232751 | 11/2012 |
| JP | 2015-101406 | 6/2015 |

* cited by examiner

[Prior art JP2012-188127]

[Prior art JP2015-101406]

AUTOMATIC INSERTION DEVICE AND AUTOMATIC INSERTION METHOD FOR BACKING-EQUIPPED SHRINK FILM PACKAGING

TECHNICAL FIELD

The present invention relates to an automatic insertion device for mount-equipped shrink film package, which inserts a sales commodity into a mount-equipped shrink film package for displaying the sales commodity in a hanging state in a shop, and a method for automatically inserting a sales commodity into a mount-equipped shrink film package.

BACKGROUND TECHNOLOGY

The commodity goods are individually dressed and displayed on the display fixture in the store. A wide variety of products that offer the same use and the similar function are arrayed and sold at the same sales spot. The manufacturers and supplier devise a package dress and display to be easy to catch the customers' eyes. One of the devices is a hanging display method. A hanging display method is a display method using a shrink film package with a mount, and is becoming popular as a packaging form in which various kinds of household small goods such as cosmetics and stationery can be displayed for catching the customers' eyes in a small space.

A mount-equipped shrink film package is made of a mount such as a cardboard having a hole to be hanged from a hook, and a cylindrical shrink film which is stuck on the surface of the mount and is long in hanging direction for packaging the product container. Since the packaged goods are hanged from the hook on the front face of the display shelf and the packaged goods are supported on the front side of the mount, the packaged goods are displayed as if pop-up from the mount and face the customers' eyes, so that this hanging display method is excellent in eye catching.

There are some problems of the prior hanging display method in inserting goods into a mount-equipped shrink film package.

As the first prior art for automatic insertion of a sales commodity into a mount-equipped shrink film package, a method disclosed in JP 2012-188127 (Prior art 1) is known.

FIG. 22 shows a method for automatic insertion of a sales commodity into a mount-equipped shrink film package disclosed in Japanese patent application No. 2012-188127 (Prior art 1). As shown in FIG. 22 (*a*), an adhesive (adhesive 3) is applied to a card (mount 1) to adhere a heat-shrinkable tube film (cylindrical shrink film 2) to make a mount-equipped shrink film package. The goods 7 to be inserted are inserted as shown in FIG. 22 (*b*), and then the heat-shrinkable tube film (cylindrical shrink film 2) is heat-shrunk to cover and support the goods 7 on the card (mount 1) by a cylindrical shrink film, as shown in FIG. 22 (*c*).

In FIG. 22, if the cylindrical shrink film tube is folded to make a vertical fold line from the upper open end to the lower open end in the center portion of the cylindrical shrink film tube, it become easier to insert the goods 7 to the cylindrical shrink film tube because the open end can be sustained easier.

As the second prior art for automatic insertion of a sales commodity into a mount-equipped shrink film package, a method disclosed in JP 2015-101406 (Prior art 2) is known.

FIG. 23 shows a method for automatic insertion of a sales commodity into a mount-equipped shrink film package disclosed in Japanese patent application No. 2015-101406 (Prior art 2). As shown in FIG. 23, a mount-equipped shrink film package fixes a product 22 by a film 4 bonded to the surface of a mount through an adhesive. The mount 3 is provided with a bending guide part 6 extending in the vertical direction, and the mount 3 can be bent to the front side at the position of the bending guide part 6 to hold a product along to its figure. A cylindrical shrink film 4 is bonded to the surface of the mount 3 having bending guide part 6 through an adhesion part 5. A product 22 is inserted into the cylindrical shrink film 4 and thereafter, the cylindrical shrink film 4 is heated and contracted along to a product shape with bending the mount 3 to the surface side at the position of the bending guide part 6. The product 22, the contracted cylindrical shrink film 4 and the mount 3 are integrally fixed along with the product shape.

Prior art 1: JP 2012-188127

Prior art 2: JP 2015-101406

DISCLOSURE OF THE INVENTION

Problem to be Solved by the Invention

As described above, a hanging display method using the mount-equipped shrink film package is an excellent method for displaying merchandise and is becoming popular as a preferable packaging form.

However, there is a problem to be solved in the prior hanging display method using the mount-equipped shrink film package.

The first problem is that it is difficult to load and insert a goods into a mount-equipped shrink film package physically, and the quality of the state of the goods in the mount-equipped shrink film package inserted by a prior automatic insertion apparatus is insufficient. The inner diameter of an employed shrink film should have a margin slightly larger than the outer diameter of the goods to be inserted, insertion becomes difficult.

Since the shrink film before heat shrinkage is a soft and easily deformable thin film, the shrink film must be kept in a substantially similar shape. For example, the shrink film must be kept in a cylindrical shape when the goods to be inserted have a columnar shape. The shrink film may be bent or broken by being caught or colliding with a part of the edge of the goods, and the inserted state becomes defective.

The second problem is that the state of a shrink film after heat shrinkage is deteriorated, not beautiful, and wrinkles or twist may occur on the shrink film.

As described above, in the prior art, it is necessary to employ a shrink film whose inner diameter is slightly larger than the outer diameter of the goods to be inserted to secure a certain margin. Therefore, the shrinkage ratio of the shrink film become large when applying heat to shrink the shrink film. The surplus film may form a stripe shape as wrinkle or twist remaining on a surface of the wrapped goods. If such wrinkle or twist becomes large visibly, the appearance of the suspended display using the mount equipped shrink film package is deteriorated.

It is an object of the present invention in view of the above problems to provide an automatic insertion device for automatically inserting goods to be inserted to a mount equipped shrink film package correctly without causing bending or generating wrinkle. The automatic insertion device of the present invention can employ a shrink film whose inner diameter is slightly larger than the outer diameter of the goods to be inserted to secure a certain margin.

Means for Solving the Problems

To achieve the above-mentioned object, the present invention of an automatic insertion device comprises the following configuration. The following configuration can be adopted in any combination as far as possible. Further, the technical features of the present invention are not limited to those described below, and it is to be understood that the technical features are recognized based on the concept of the invention which can be understood by those skilled in the art from the description of the specification and drawings or the description thereof.

An automatic insertion device of the prevent invention for inserting goods into a mount equipped shrink film package in which an inner diameter of a shrink film is larger than an outer diameter of the goods comprises a mounting device arranging the goods and the mount equipped shrink film package in series along the inserting direction; an insertion guide body including a head part whose outer diameter is smaller than the inner diameter of the shrink film, and one or plural air blowing ports or air blowing grooves for blowing air to outer direction from the surface of the insertion guide body; a slider device for sliding either or both the insertion guide body and the mount equipped shrink film package where the insertion guide body and mount equipped shrink film package are arranged in series, the insertion guide body is located on the opposite side of the goods in between the mount equipped shrink film package; wherein an inserting preparation operation is executed, in which the insertion guide body is inserted into the shrink film with blowing air for bulging the shrink film figure on the mount equipped shrink film package until facing the goods, wherein an inserting operation is executed, in which the insertion guide body with the goods or the mount equipped shrink film package are relatively moved to each other for inserting the goods into the mount equipped shrink film package at the predetermined position.

As the relative motion in the inserting operation, the first pattern is the way that the mount equipped shrink film package is fixed, and the insertion guide body with the goods are moved to the mount equipped shrink film package.

As the relative motion in the inserting operation, the second pattern is the way that the insertion guide body with the goods are fixed, the mount equipped shrink film package is moved to the insertion guide body with the goods.

According to the above configuration, the insertion guide body can provide air blown out from an air blowing port. When at least a part of the insertion guide body is put into the inner of the shrink film tube, the blown air covers the outer surface of the side surface of the insertion guide body as if the insertion guide body dresses air cloth. As a result, the shrink film tube is held in a substantially cylindrical shape by the air pressure, and the goods to be inserted can be easily pulled in.

Even at an opening end where the bending or twist is likely to occur, the opening end of the shrink film tube is tightly held in a substantially cylindrical shape by the blown air. In particular, when the goods to be inserted are pulled or pushed together with the insertion guide body and approaches the opening end, the flowing air can flows through only a narrow gap between opening of the shrink film and the approaching edge of the goods, so the state of the opening end of the shrink film tube is more firmly held and maintained in a substantially cylindrical shape.

In the above configuration, it is preferable that the insertion guide body includes a goods suction part on the front edge of its head part, which goods suction part can suction the goods. In the inserting preparation operation, the goods suction part once goes through the shrink film of the mount equipped shrink film package and attaches the goods facing the mount equipped shrink film package and suctions the goods. In the inserting operation, the goods suction part returns to the mount equipped shrink film package with suctioning and pulling the goods as one continuous body.

It is preferable that the goods suction part includes an air suction mechanism. In the inserting operation, the air suction mechanism is activated when the goods is moved to the predetermined position and deactivated when the goods is moved to the predetermined position to release the goods on the predetermined position.

It is preferable that the distance between the shrink film of the mount equipped shrink film package and the goods arranged in series on the mounting device is narrower than the length of the head part of the insertion guide body. This is because it is desirable that at least the rear end of the head part of the insertion guide body remains inside of the shrink film, and not to go through the shrink film when contacting the front edge of the insertion guide body to the goods.

According to the above configuration, when the front edge of the insertion guide body goes through the shrink film and contact with the goods, at least the part of the insertion guide body remains in the shrink film tube, not go through the shrink film. Therefore, the shrink film can keep on bulging in a round shape without bending or generating wrinkle by the flow of air, and the insertion guide body can move smoothly in the shrink film.

It is preferable that the slider device includes a pushing means for pushing the goods into the shrink film of the mount equipped shrink film package. In the inserting operation, the insertion guide body is moved by the pushing means of the slider device, wherein the goods is moved together with the insertion guide body to the shrink film of the mount equipped shrink film package, wherein both motion is synchronized for pushing the goods up to the predetermined position of the shrink film of the mount equipped shrink film package.

According to the above configuration, the insertion guide body can bulge the shrink film in the inserting preparation operation, and the goods can be inserted into the shrink film tube by the pushing means, which moves in synchronization with the motion of the insertion guide body.

The relation of the outer diameter of the insertion guide body, the outer diameter of the goods and the inner diameter of the shrink film are described below.

The outer diameter of the insertion guide body is smaller than the inner diameter of the shrink film tube. For example, the outer diameter of the insertion guide body may be several millimeters smaller than the inner diameter of the shrink film tube. The outer diameter of the insertion guide body can be suitable if the shrink film tube can be bulged by the air blowing from the insertion guide body according to the air blowing pressure from the outer surface of the air blowing port.

It is preferable that the outer diameter of the insertion guide body decreases toward the head.

If the insertion guide body has such an outer configuration, the insertion guide body can easily go into the shrink film tube from its head in the sliding motion of the insertion guide body in the inserting preparation operation.

If the insertion guide body includes the goods suction part on the front edge of its head part, it is preferable that the outer diameter of the goods suction part may be smaller than the inner diameter of the shrink film tube and also smaller than the outer diameter of the head part of the insertion guide body.

It is preferable that the shrink film suction part includes a lifting mechanism vertically moving up and down for accessing and contacting the shrink film from the upper direction, wherein the shrink film suction part suctions and lifts up the upper surface of the shrink film of the mount equipped shrink film package for opening an opening of the shrink film and keeping the opening open by air suction. Prior to an inserting preparation operation, the shrink film suction part descends toward the vicinity of the opening of the shrink film, then contacts with the shrink film around its opening by the lifting mechanism, suctions the opening of the shrink film, then rises and lifts up the opening of the shrink film for opening and keeping the opening of the shrink film.

If the shrink film suction part keeps on suctioning the shrink film for sustaining the opening, the insertion guide body can go into the shrink film tube easily in the sliding motion of the insertion guide body in the inserting preparation operation.

After starting the insertion guide body going into the shrink film via the opening of the shrink film, the shrink film suction part may release the shrink film by deactivating the air suction. The shrink film suction part can leave apart from the way of the motion of the insertion guide body and the goods.

An automatic insertion method of the present invention for inserting goods into a mount equipped shrink film package in which an inner diameter of a shrink film is larger than an outer diameter of the goods comprises: arranging the goods and the mount equipped shrink film package in series along the inserting direction; employing an insertion guide body including a head part which outer diameter is smaller than the inner diameter of the shrink film, and at least more than one air blowing port or air blowing groove for blowing air to outer direction from the surface of the insertion guide body, and employing a slider device for sliding either or both the insertion guide body and the mount equipped shrink film package.

The automatic inserting method is operated by the following steps.

The insertion guide body and mount equipped shrink film package are arranged in series, and the insertion guide body is located on the opposite side of the goods in between the mount equipped shrink film package.

In the inserting preparation operation, the insertion guide body is inserted into the shrink film with blowing air for bulging the shrink film figure on the mount equipped shrink film package up to facing the goods.

In the inserting operation, the insertion guide body with the goods or the mount equipped shrink film package are relatively moved to each other for inserting the goods into the mount equipped shrink film package up to the predetermined position.

In the above method, the relative motion in the inserting operation may be such that the mount equipped shrink film package is fixed, and the insertion guide body with the goods are moved to the mount equipped shrink film package. Instead, the relative motion in the inserting operation may be such that the insertion guide body with the goods are fixed, the mount equipped shrink film package is moved to the insertion guide body with the goods.

Effects of the Invention

According to the present invention, the automatic insertion device for mount equipped shrink film package can provide air blown out from an air blowing port of the insertion guide body. The blown air covers the outer surface of the side surface of the insertion guide body as if the insertion guide body dresses air cloth. When at least a part of the insertion guide body is put into the inner of the shrink film tube, the shrink film tube is held in a substantially cylindrical shape by the atmospheric pressure, and the goods to be inserted can be easily pulled in.

Even at an opening end where the bending or twist is likely to occur, the air blows out, so that the opening end of the shrink film tube is tightly held in a substantially cylindrical shape. In particular, when the goods to be inserted are pulled together with the insertion guide body and approaches the opening end, the flowing air can flows through only a gap between opening of the shrink film and the approaching edge of the goods, so the state of the opening end of the shrink film tube is more firmly held and maintained in a substantially cylindrical shape.

The insertion guide body, the mount equipped shrink film package and the goods to be inserted are relatively moved to each other, so that the goods can be easily inserted to the mount equipped shrink film package.

DETAILED DESCRIPTION OF THE PREFERRED EMBODIMENT

Some Embodiments of an automatic insertion device according to the present invention are described below with reference to the relevant drawing. Needless to add, the claims of the present invention include but are not limited to the application, configuration, or quantity shown in the following Embodiments.

As Embodiment 1, the first configuration of an automatic insertion device for a mount equipped shrink film package according to the present invention is described. A goods suction part is provided at the front portion of the head of the insertion guide body. In the relative movement of the inserting operation, the mount equipped shrink film package is fixed, and the goods to be inserted are pulled into the mount equipped shrink film package while the insertion guide body suctions the goods by the goods suction part.

As Embodiment 2, the second configuration of an automatic insertion device for a mount equipped shrink film package according to the present invention is described. A goods pushing part is provided at the front portion of the head of the insertion guide body. In the relative movement of the inserting operation, the mount equipped shrink film package is fixed, and the goods to be inserted are pushed into the mount equipped shrink film package while the insertion guide body pushes the goods by the goods pushing part.

As Embodiment 3, the third configuration of an automatic insertion device for a mount equipped shrink film package according to the present invention is described. In the relative movement of the inserting operation, the insertion guide body and the goods to be inserted are fixed together, and the mount equipped shrink film package is moved to the goods until the appropriate distance where the goods are inserted to the appropriate position.

Embodiment 1

As Embodiment 1, an automatic insertion device for a mount equipped shrink film package according to the present invention is described. A mount equipped shrink file package is fixed, and an insertion guide body and goods to be inserted are moved together along the inserting direction in the relative movement of the inserting operation. A goods suction part is provided at the front portion of the head of the insertion guide body. The goods to be inserted are pulled and moved following the insertion guide body by the goods suction part.

The automatic insertion device 100 for a mount equipped shrink film package according to Embodiment 1 is described.

Figure 1:
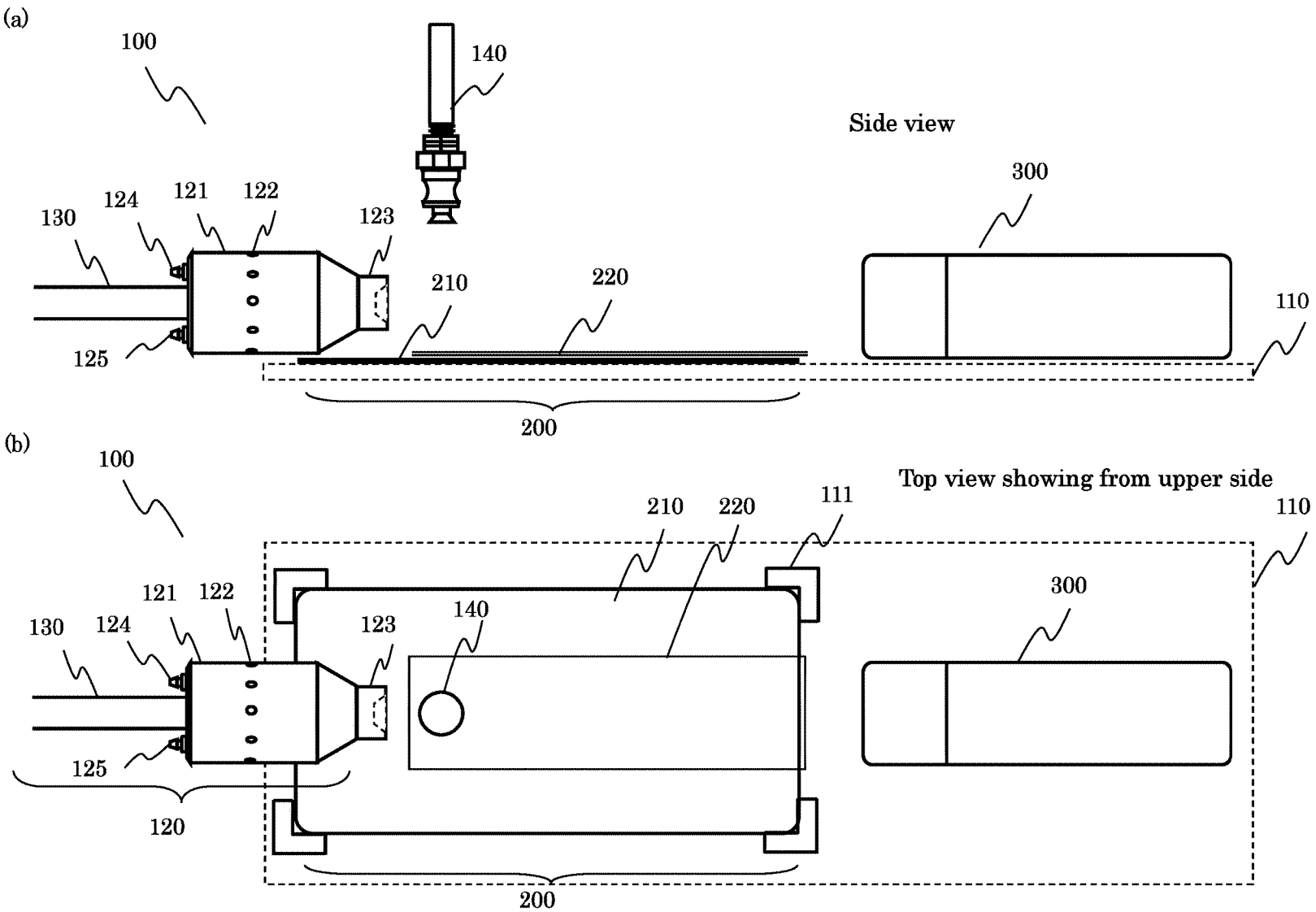
FIG. 1 is a schematic view of an example of the configuration of an automatic insertion device 100 for a mount equipped shrink film package according to Embodiment 1.

FIG. 1 is a schematic view of an example of the configuration of an automatic insertion device 100 for a mount equipped shrink film package according to the Embodiment 1. As shown in FIG. 1, the automatic insertion device 100 for a mount equipped shrink film package comprises a mounting device 110, an insertion guide body 120, a slider device 130 and a shrink film suction part 140. In FIG. 1, a mount equipped shrink film package 200 and goods 300 to be inserted are shown together with the automatic insertion device 100.

The mount equipped shrink film package 200 includes mount 210 and a shrink film 220 attached to the mount 210. One of the conditions for the automatic insertion device 100 for automatic insertion is that the inner diameter of the shrink film 220 is slightly larger than the outer diameter of the goods to be inserted. If the inner diameter of the shrink film 220 is smaller than the outer diameter of the goods to be inserted, it is not applicable physically, and if the inner diameter of the shrink film 220 is enough larger than the outer diameter of the goods to be inserted, it may applicable but the shrink film wrapping result state become deteriorate after heat shrinkage process.

In the following description, the goods to be inserted have a substantially columnar shape.

Hereinafter, each component of the automatic insertion device 100 for the mount equipped shrink film package is described.

The mounting device 110 is a device in which the goods 300 to be inserted and the mount equipped shrink film package 200 are arranged in series along the inserting direction of the goods 300 to the mount equipped shrink film package 200. The configuration of the mounting device 110 may not be limited as long as the goods 300 and the mount equipped shrink film package 200 can be arranged in series. In the mounting device 110, a portion on which the goods 300 is placed and a portion on which the mount equipped shrink film packaging 200 is placed may be in an integral state or a separate state.

For example, the goods 300 are provided one after another as sequentially conveyed by a conveyance system such as a belt conveyor, and the mount equipped shrink film package 200 is also provided from a stacker one after another sequentially conveyed by a conveyance system such as a belt conveyor. As shown in FIG. 1, when both the goods 300 and the mount equipped shrink film package 200 come to the predetermined position of the mounting device 110, both the goods 300 and the mount equipped shrink film package 200 are arrayed in series along to the inserting direction of the goods 300 to the mount equipped shrink film package 200.

An interval between arrangement of the goods 300 and the mount equipped shrink film package 200 in the mounting device 110 is described. The interval between the goods 300 and the mount equipped shrink film package 200 in the mounting device 110 is set to be narrower than the length of the head part 121 of the insertion guide body 120 in the inserting direction. As described later, the insertion guide body 120 is inserted into the shrink film 220 and go through the inside of the shrink film tube to sure a state of the shrink film 220 is bulged up to the cylindrical shape with air pressure before operation of the goods inserting. After making this state the goods 300 is inserted to the shrink film 220 bulged up to the cylindrical shape with air pressure. Therefore, at the moment of contacting the front edge of the insertion guide body 120 to the goods 300, at least the rear end of the head part 121 of the insertion guide body 120 remains inside of the shrink film 220, not to go through the shrink film 220.

This condition is described later with reference to FIG. 8

Next, the insertion guide body 120 is described.

The insertion guide body 120 includes a head part 121, an air blowing port 122, a goods suction part 123, an air pump connection part 124, and a negative pressure pump connection part 125.

The head part 121 has a cylindrical outer shape. The outer diameter "r" of the head part 121 is substantially equal to or slightly smaller than an outer diameter "R" of the goods 300. That is, the head part 121 is previously inserted into the shrink film 220 of the mount equipped shrink film package 200 and the shrink film 220 is bulged up to a substantially cylindrical shape in advance so the goods 300 to be inserted can be easily inserted.

The air blowing port 122 is an air blowing part for blowing air from the inside of the head part 121 toward the outer surface, and at least one air blowing port 122 is provided on the side surface of the head part 121. An air pressure is appropriately applied to the air blowing port 122 to blow out air from the inside. The air blowing port 122 may be a hole or a groove-shaped (air blowing groove). In this example, an air blowing port 122 is described as a hole.

In this example, air is blown out through the air pump connection part 124 which is connected to the air pressure pump (not shown) for providing air pressure for air blowing to the air blowing port 122.

Next, air pump connection part 124 is a connection port with an air pump (not shown) for blowing air by applying a predetermined air pressure. It blows air to the air blowing port 122. The internal structure of the head part 121, which is a supply passage of air from the air pressure pump connection part 124 to the air blowing port 122, is not shown. Any configuration which can provide airtight space reaching the air blowing port 122 from the air pressure pump connection part 124 can be employed.

Figure 2:
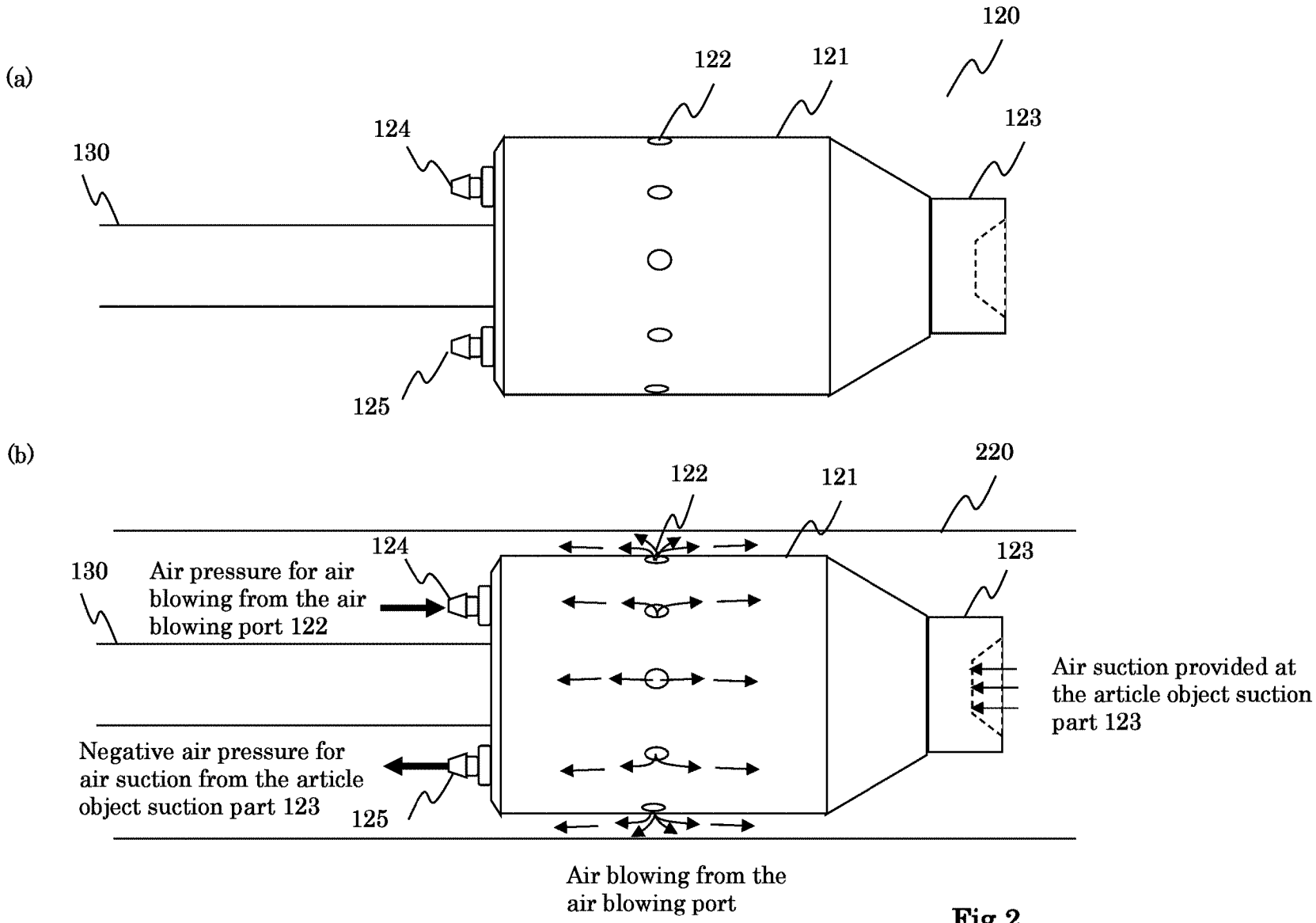
FIG. 2 is a schematic view showing a state in which air is supplied from an air blowing port 122 of the insertion guide body 120.

FIG. 2 is a schematic view showing a state in which air is supplied from an air blowing port 122 of the insertion guide body 120. As shown in FIG. 2 (*b*), when the head part 121 is inserted into the shrink film 220, the state of the shrink film 220 become cylindrical shape bulged by air pressure because air is blown out from the air blowing port 122 into the shrink film 220.

The amount of air blown out from the air blowing port 122 and the air injection speed may be adjusted according to the size of the shrink film 220 and the size of the goods 300.

Next, the goods suction part 123 is described.

The goods suction part 123 is a suction mechanism for goods 300 contacted at the front of the head part 121 for suctioning. A negative pressure for air suction is provided to the goods suction part 123 via a negative pressure pump connection part 125. In another configuration, a suction disk can be employed as long as the goods 300 can be securely suctioned.

In this Embodiment 1, the goods suction part 123 is suctioning means for sliding the goods 300 along the inserting direction in the sliding operation of the insertion guide body 120. The goods 300 are slid along the inserting direction by pulling the goods 300 together with the sliding movement of the insertion guide body 120 while suctioning the goods 300 by the object suction section 123.

It is preferable that the outer diameter of the goods suction part 123 is smaller than that of the head part 121 of the insertion guide body and smaller than the inner diameter of the shrink film 220. As shown in FIG. 1, if the outer diameter of the goods suction part 123 is smaller than that of the head part 121 of the insertion guide body. The outer diameter of the insertion guide body 120 decreases toward the head. The goods suction part 123, which is installed at the head part 121, can be easily inserted into the inside of the shrink film 220, and thereafter, the head part 121 followed by the whole insertion guide body 120 can be smoothly inserted into the shrink film 220.

Negative air pressure for air suction is provided to the goods suction part 123 via the negative pressure pump connection part 125.

The negative pressure pump connection part 125 is a connection port with an air pump (not shown) for suctioning air by applying predetermined negative air pressure, and suctions air from the goods suction part 123. The internal structure of the head part 121, which is a suction passage of air from the negative pressure pump connection part 125 to the goods suction part 123, is not shown. Any configuration that can provide airtight space reaching the air blowing port 122 from the air pressure pump connection part 124 can be employed.

The activation and the deactivation of the application of negative air pressure to the goods suction part 123 can be controlled by controlling the opening and closing of a connection with the negative pressure pump connection part 125, and as a result, air suction ON and OFF in the goods suction part 123 can be switched.

Next, the slider device 130 is described.

The slider device 130 is a device for sliding either or both the insertion guide body 120 and the mount equipped shrink film package 200. The slide motion is not limited as long as the insertion guide body 120 and the mount equipped shrink film package 200 are relatively moved. Either the insertion guide body 120 or the mount equipped shrink film package 200 may be moved. In this embodiment, the way in which the insertion guide body 120 slides is employed.

The insertion guide body 120 is pushed out from a rear end (left side in the figure) by the slider device 130, and the insertion guide body 120 is inserted into the shrink film 220 of the mount equipped shrink film package 200 from its head. The insertion guide body 120 is further slid and moved until the insertion guide body 120 reaches the goods 300. The same result can be obtained if the mount equipped shrink film package 200 slides and the position of the insertion guide body 120 is fixed, and the insertion guide body 120 accepts the mount equipped shrink film package 200.

This motion is executed in the inserting preparation operation described later.

In Embodiment 1, at the end of the inserting preparation operation, the goods suction part 123 contacts with the goods 300 and starts suctioning.

In this example, during the inserting operation, a slide motion of the insertion guide body 120 is executed by pulling the insertion guide body 120 back from the rear side. During the slide motion, negative air pressure is being applied to the goods suction part 123 via the negative pressure pump connection part 125. The goods suction part 123 slides and moves in the shrink film 220 while suctioning and pulling the goods 300. In this Embodiment 1, the slide motion of the insertion guide body 120 with the goods suction part 123 carrying the goods 300 in the shrink film 220 in this inserting operation.

When the goods 300 reaches a predetermined position in the shrink film 220, the negative air pressure applied to the object suction section 123 via the negative pressure pump connection section 125 is stopped. When the suction applied to the goods 300 is stopped, the goods 300 are released and stay at this position. This operation is executed as one of relative motion of the inserting operation to be described later.

The insertion guide body 120 further keeps on sliding back to an initial setting position consecutively. Of course, it is possible that the slider device 130 is temporarily stopped when the goods 300 reach a predetermined position in the shrink film 220. After ensuring the position of the goods 300 in a predetermined position, then the slider device 130 restarts the slide motion and slides back to an initial setting position.

Next, the shrink film suction part 140 is described.

The shrink film suction part 140 has an air suction part at its tip, and a negative pressure supply mechanism (not shown) for supplying negative air pressure to the air suction part 140. The switching ON/OFF of the air suction force at the tip of the shrink film suction part 140 can be controlled.

As shown in FIG. 1, the shrink film suction part 140 is arranged above the mounting device 110 just below the opening of the shrink film 220. The shrink film suction part 140 is provided with a lifting mechanism (not shown) that vertically moves up and down. The shrink film suction part 140 relates to the sliding motion of the insertion guide body 120 by the slider device 130. The shrink film suction part 140 descends toward the vicinity of the opening of the shrink film 220 prior to the inserting preparation operation and contacts with the shrink film 220 around its opening. While suctioning the opening of the shrink film 220, the shrink film suction part 140 rises to lift up the opening of the shrink film 220. As a result, the opening of the shrink film 220 is largely opened, and the object suction part 123 at the tip of the insertion guide body 120 can be easily inserted into the opening of the shrink film 220.

When the insertion guide body 120 enters the opening of the shrink film 220, the shrink film suction part 140 stops air suction to release the shrink film 220.

Next, a flow of operation of the automatic insertion device 100 for the mount equipped shrink film package according to Embodiment 1 is described. In FIG. 3 to 11, drawing (a) shows a side view, and drawing (b) shows a top view showing from upper side.

Figure 3:
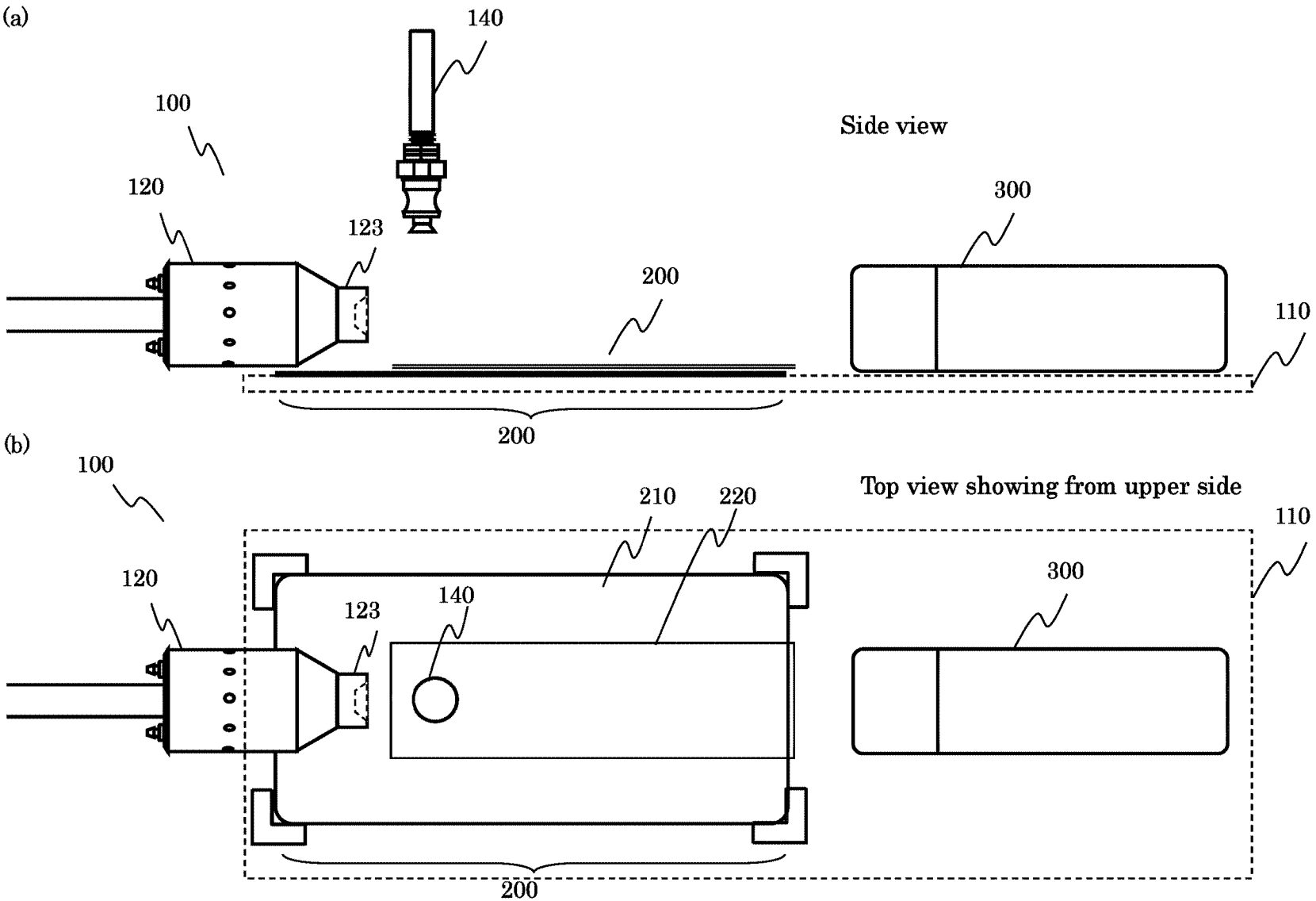
FIG. 3 is a schematic view (part 1) showing the flow of the operation of the automatic insertion device 100 for the mount equipped shrink film package according to the Embodiment 1 of the present invention.

FIG. 3 is a schematic view showing an initial state of the stroke of the operation of the automatic insertion device 100 for the mount equipped shrink film package according to the Embodiment 1 of the present invention.

The initial state is similar to that of FIG. 1. The mount equipped shrink film package 200 and the goods 300 are arranged at a predetermined position on the mounting device 110. As shown in FIG. 3 (*b*), the shrink film 220 of the mount equipped shrink film package 200 and the goods 300 are arranged in series along the inserting direction by the mounting device 110 as shown in FIG. 3 (*a*). The distance between the shrink film 220 of the mount equipped shrink film package 200 and the goods 300 is narrower than the length of the head part 121 of the insertion guide body 120.

Figure 4:
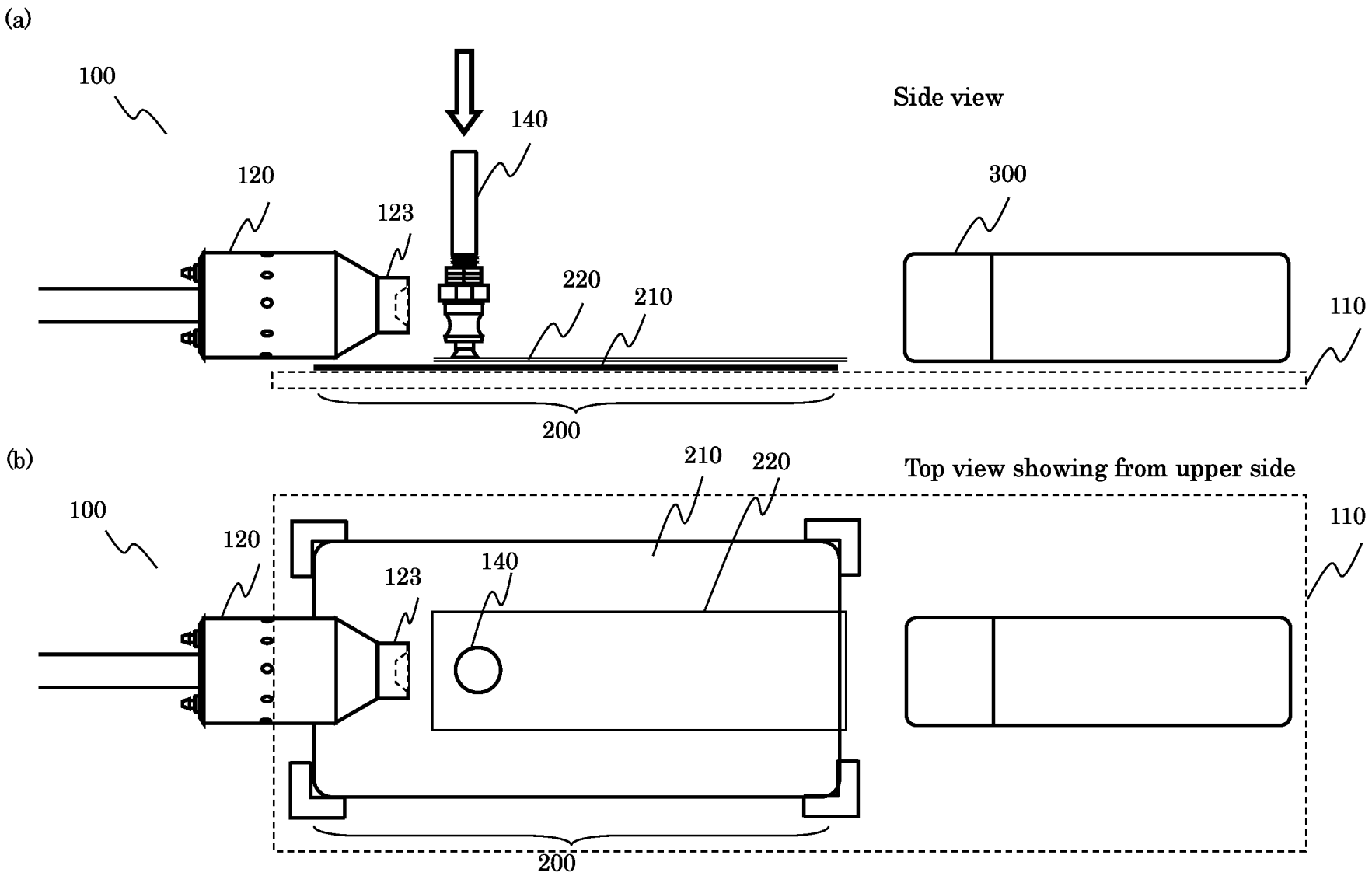
FIG. 4 is a schematic view (part 2) showing the flow of the operation of the automatic insertion device 100 for the mount equipped shrink film package according to the Embodiment 1 of the present invention.

First, as shown in FIG. 4, prior to the start of the inserting preparation operation, the shrink film suction part 140 descends toward the vicinity of the opening of the shrink film 220 of the mount equipped shrink film package 200 by the lifting mechanism. A negative air pressure is applied to the suction part at the tip of the shrink film suction part 140. The shrink film suction part 140 contacts with the shrink film 220 around its opening, and the shrink film 220 is firmly suctioned by the shrink film suction part 140.

Figure 5:
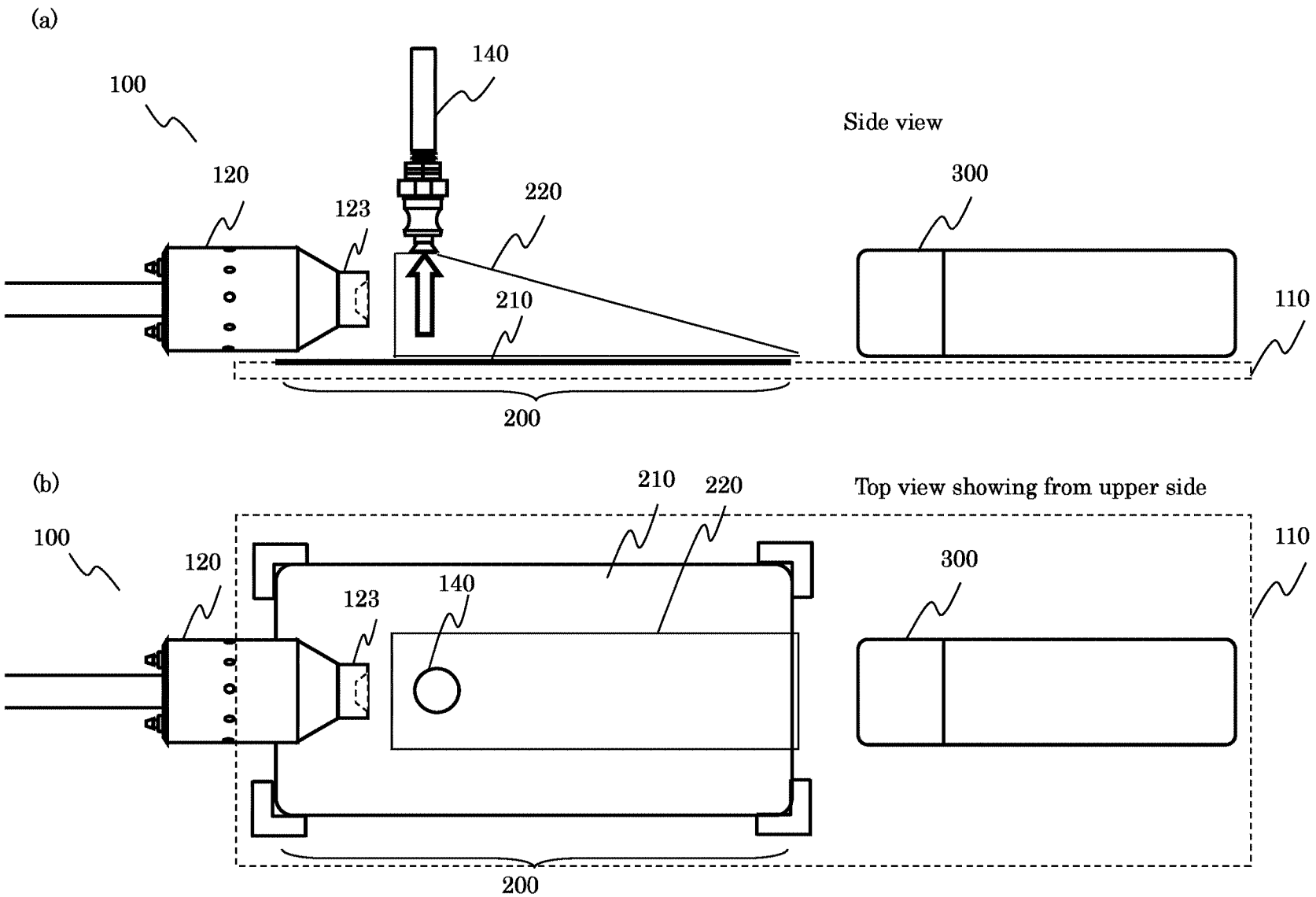
FIG. 5 is a schematic view (part 3) showing the flow of the operation of the automatic insertion device 100 for the mount equipped shrink film package according to the Embodiment 1 of the present invention.

Next, as shown in FIG. 5 (*a*), the shrink film suction part 140 is raised to a height (outer diameter) of the head part 121 of the insertion guide body 120 by the lifting mechanism. The shrink film suction part 140 keeps on applying the air suction by the suction part, raises only the upper side of the opening of the shrink film 220. The lower side of the opening of the shrink film 220 adhered to the mount 210 and the mount 210 remains on the mounting device 110. Thus, the opening of the shrink film 220 is opened.

Next, the inserting preparation operation starts.

The inserting preparation operation is an operation for bulging the shrink film 220 by inserting the insertion guide body 120 into the shrink film 220 while blowing air outer direction from the surface of the insertion guide body 120, and bringing the shrink film 220 to a bulging state in which the opening of the shrink film is opened facing the goods 300.

Figure 6:
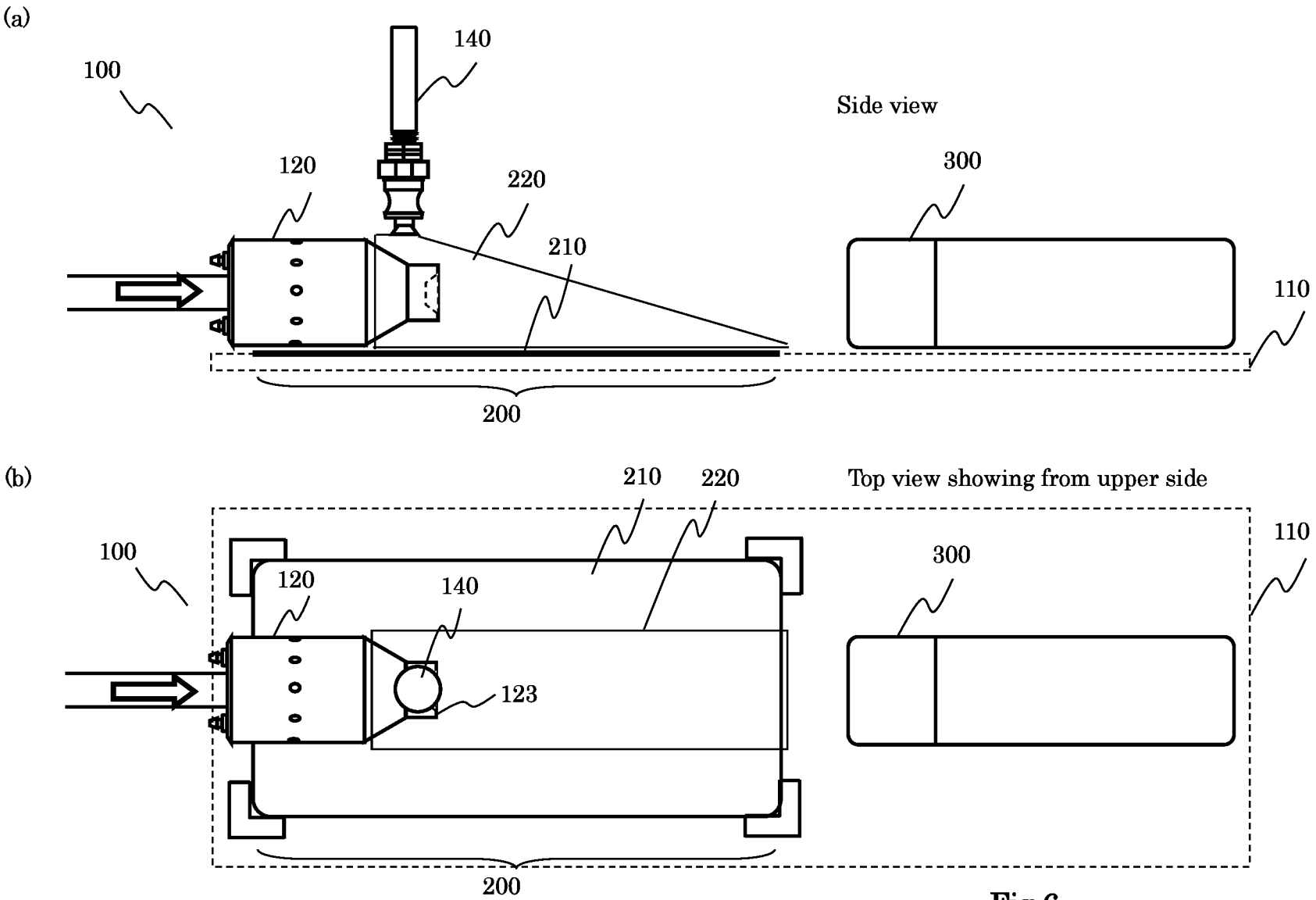
FIG. 6 is a schematic view (part 4) showing the flow of the operation of the automatic insertion device 100 for the mount equipped shrink film package according to the Embodiment 1 of the present invention.

In this case, as shown in FIG. 6, when the inserting preparation operation is started, the slide motion of the slider device 130 is started, and the head part 121 of the insertion guide body 120 is pushed. The goods suction part 123 at the head of the insertion guide body 120 enters the inside of the shrink film 220 from its opening. Since the outer diameter of the goods suction part 123 is smaller than that of the head part 121 of the insertion guide body, the outer diameter of the insertion guide body 120 decreases toward the head, and the following head part 121 is smoothly inserted when the goods suction part 123 at the tip is inserted into the shrink film 220.

Figure 7:
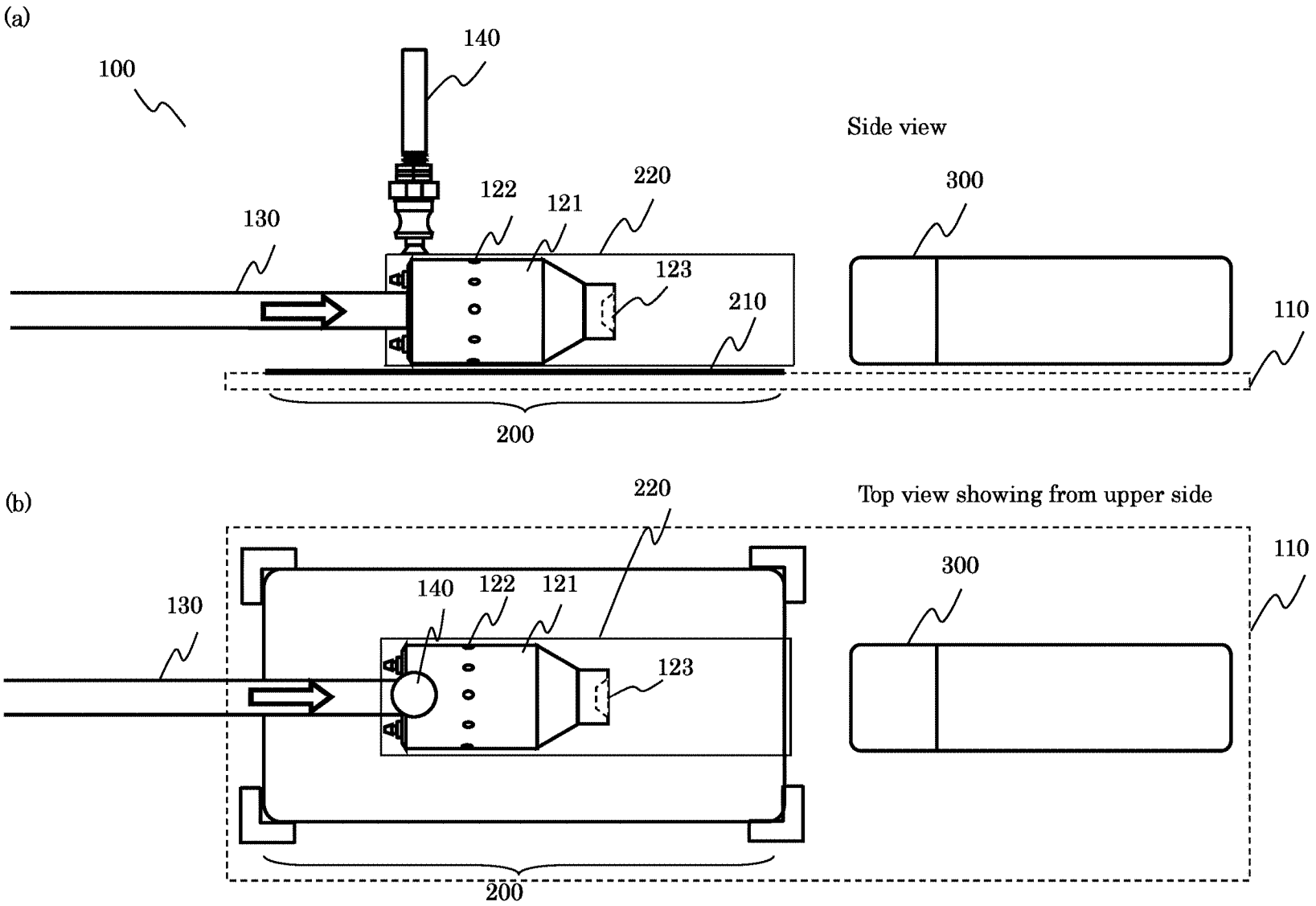
FIG. 7 is a schematic view (part 5) showing the flow of the operation of the automatic insertion device 100 for the mount equipped shrink film package according to the Embodiment 1 of the present invention.

Next, as shown in FIG. 7, when the pushing of the insertion guide body 120 by the slider device 130 proceeds, the head part 121 is inserted into the shrink film 220, and the air blowing port 122 is also positioned inside of the shrink film 220. An air pressure is applied from the air pump (not shown) via the air pump connection part 124 to the air blowing port 122 to blow air.

As shown in FIG. 7, when the air blowing port 122 is also positioned inside of the shrink film 220, the internal air pressure of the shrink film 220 becomes high as shown in FIG. 2 (*b*). The shrink film 220 is bulged in a cylindrical shape. The cylindrical shape is maintained during air flowing between the space of the head part 121 of the insertion guide body 120 and the shrink film 220. The shrink film 220 is bulged in a round shape without bending or generating wrinkle. By the flow of air, the head part 121 and the shrink film 220 are not brought into contact with each other as separated by the air therebetween. The friction force is also reduced, so the head part 121 smoothly advances in the shrink film 220. In this process, the negative pressure of the shrink film suction part 140 is deactivated, and the suction of the shrink film 220 is stopped, so the upper surface of the shrink film 220 is released from the shrink film suction part 140. The shrink film suction part 140 rises to the height of the initial state.

Figure 8:
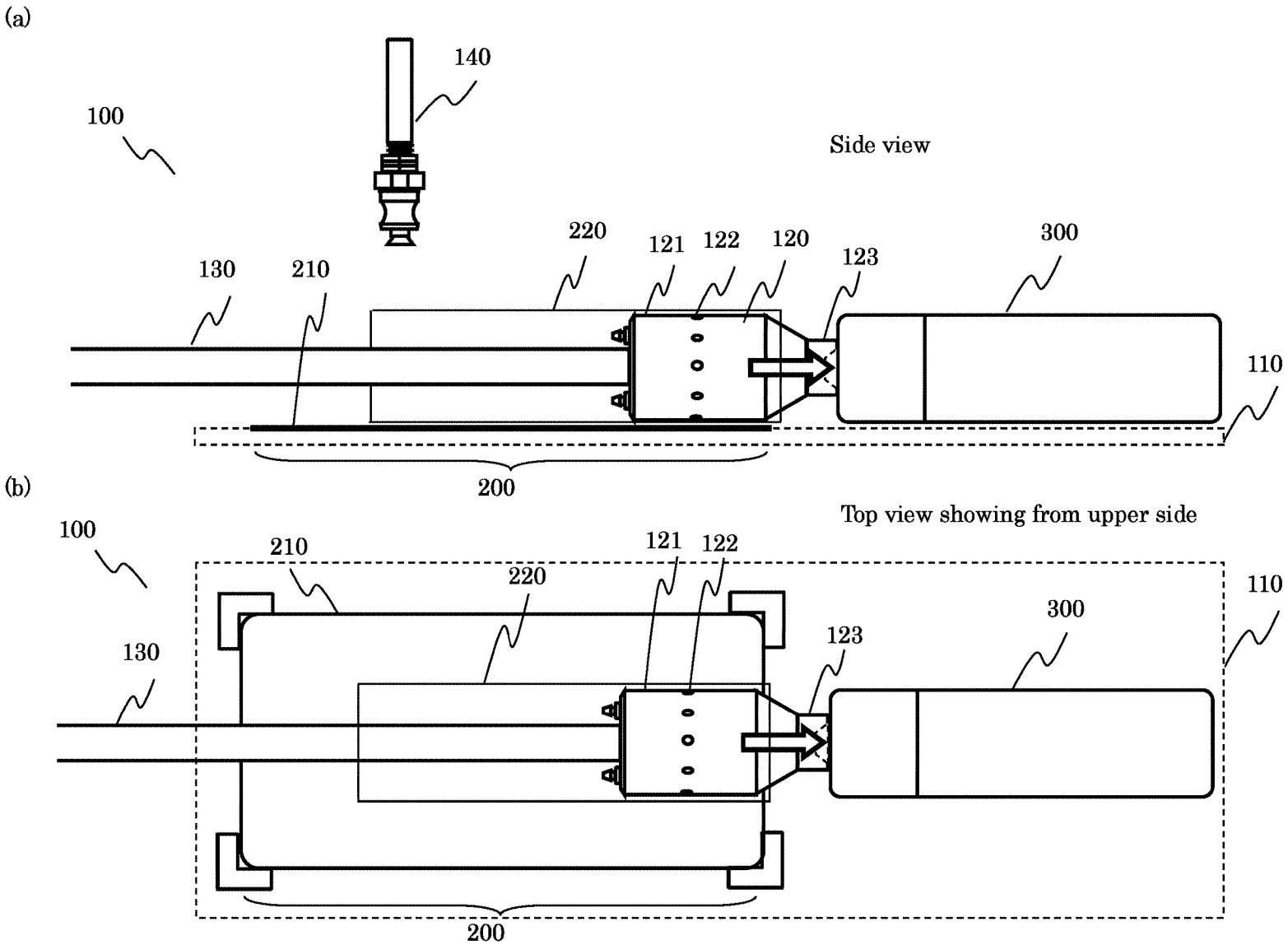
FIG. 8 is a schematic view (part 6) showing the flow of the operation of the automatic insertion device 100 for the mount equipped shrink film package according to the Embodiment 1 of the present invention.

Next, as shown in FIG. 8, when the pushing of the insertion guide body 120 by the slider device 130 proceeds, the front of the head part 121 goes through the shrink film 220, and the goods suction part 123 contacts the goods 300.

In this Embodiment 1, execution of the inserting preparation operation is completed in this stage.

In this Embodiment 1, negative air pressure is applied from the air pump to the goods suction part 123 via a negative pressure pump connection part 125, and air suction force is given to the goods suction part 123. The goods suction part 123 securely suctions the goods 300.

Next, the inserting operation starts.

The inserting operation is an operation for moving either one of the insertion guide body 120 or the goods 300 and the mount equipped shrink film package 300 relative to the other and pulling or pushing the goods 300 to a predetermined position in the shrink film 220.

In this Embodiment 1 of the relative motion in the inserting operation, the mount equipped shrink film package 300 is fixed and the insertion guide body 120 and the goods 300 are moved along the inserting direction. In this configuration example, when the slider device 130 starts back sliding motion and the slider device 130 starts pulling back the insertion guide body 120. The suction force of the goods suction part 123 of the insertion guide body 120 is maintained, so that the goods 300 follow the insertion guide body 120 by the suction force.

Figure 9:
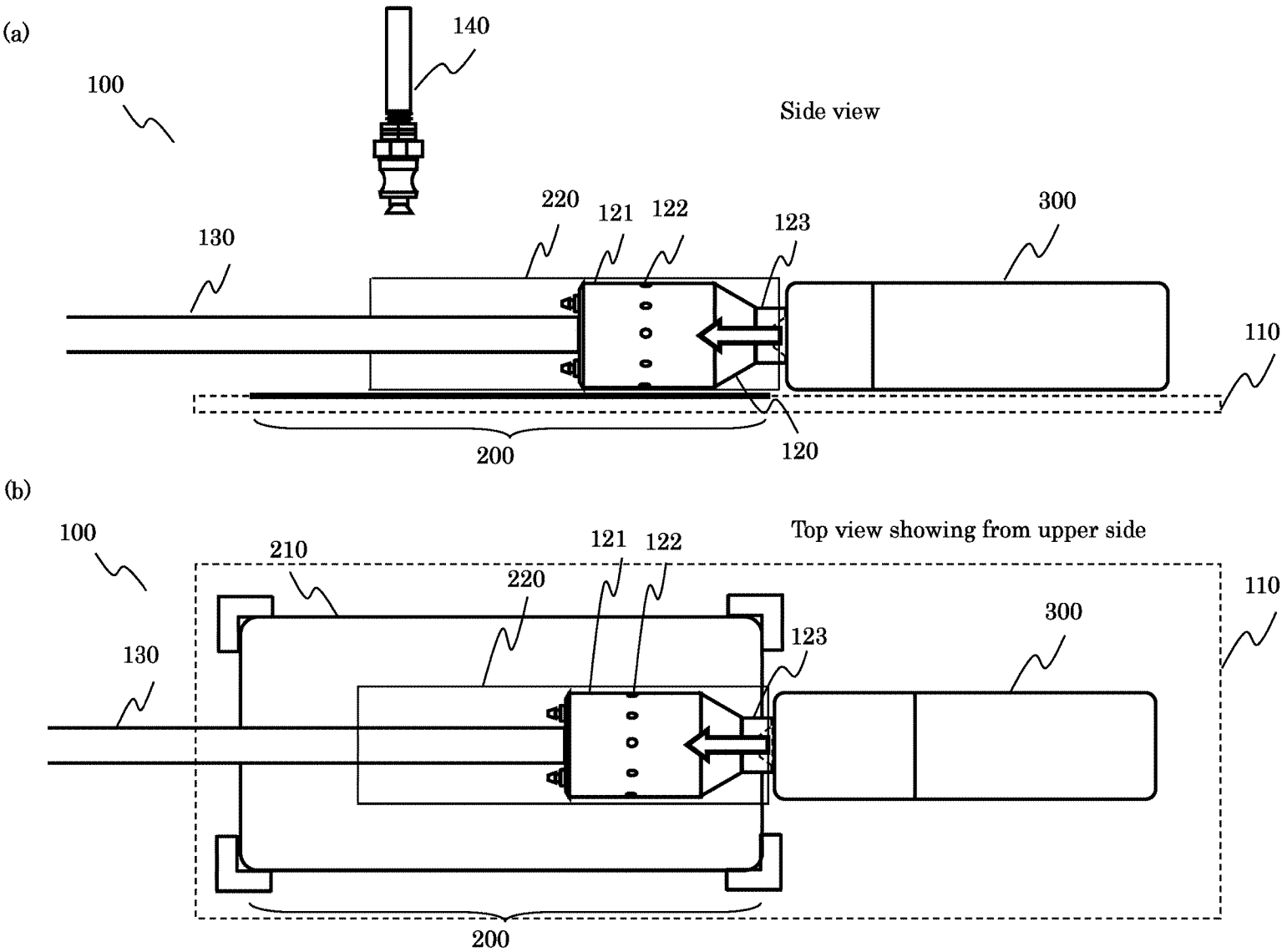
FIG. 9 is a schematic view (part 7) showing the flow of the operation of the automatic insertion device 100 for the mount equipped shrink film package according to the Embodiment 1 of the present invention.

As shown in FIG. 9, the edge of the goods 300 approaches the facing opening of the shrink film 220. When the slider device 130 keeps on sliding the insertion guide body 120, the edge of the goods 300 is inserted via the opening of the shrink film 220.

The bulging effect of the shrink film 220 occurring in the vicinity of the end opening of the shrink film 220 is described.

Figure 12:
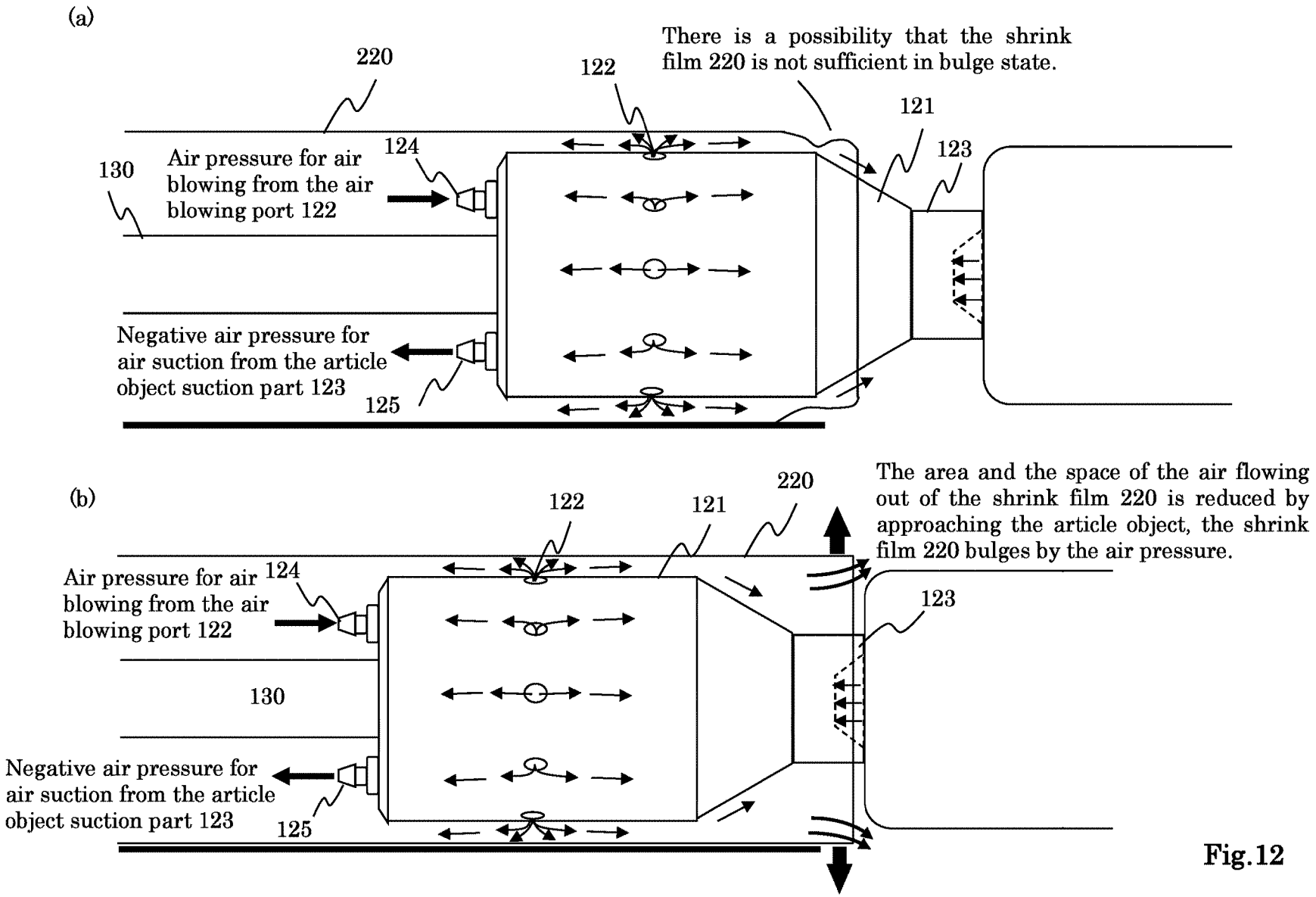
FIG. 12 is a schematic view (part 1) describing the swelling effect of the shrink film 220 generated near the end opening of the shrink film 220 in detail.
Figure 13:
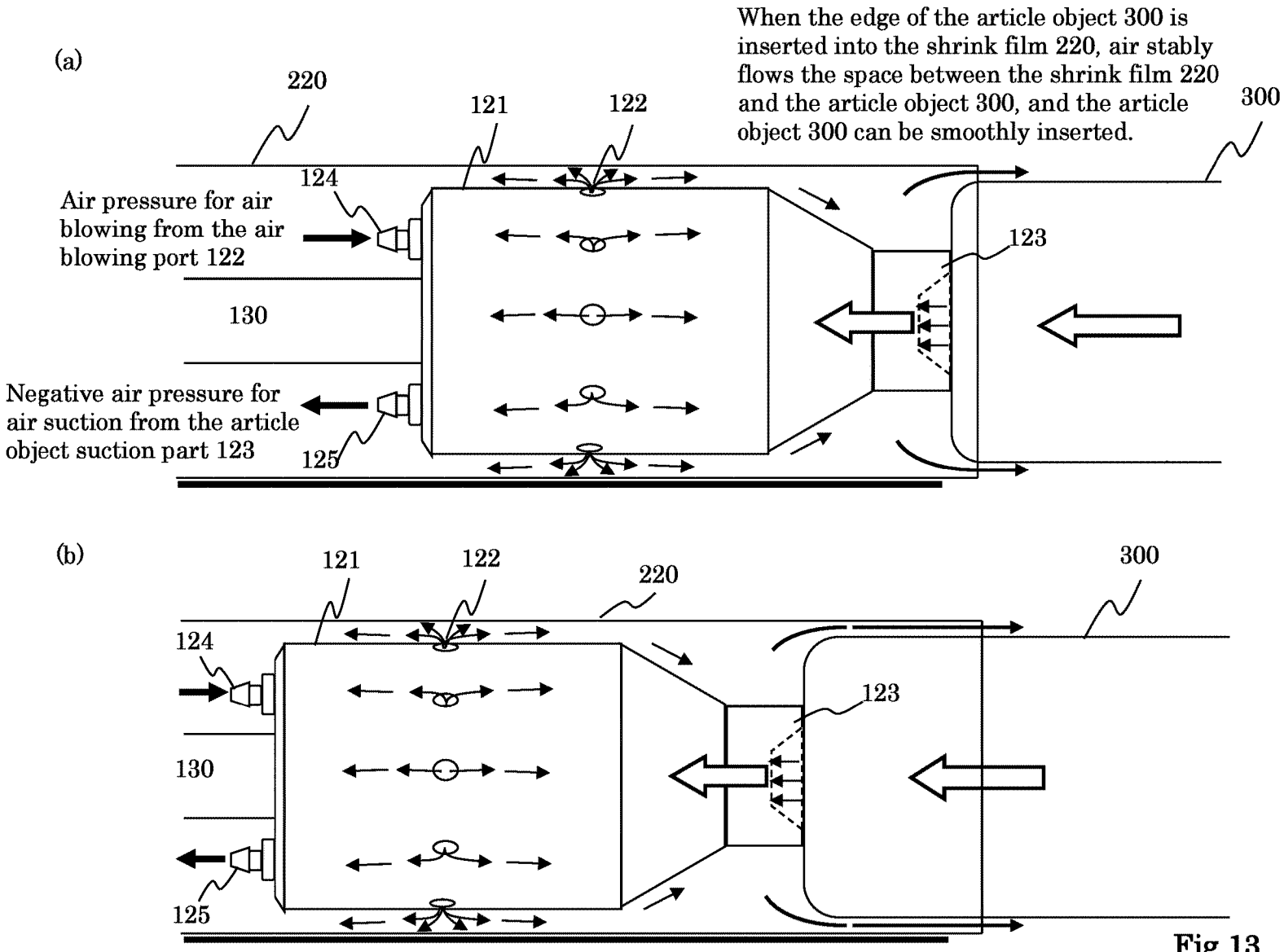
FIG. 13 is a schematic view (part 2) describing the swelling effect of the shrink film 220 generated near the end opening of the shrink film 220 in detail.

The flows shown by FIG. 12 (*a*)-FIG. 12 (*b*)-FIG. 13 (*a*)-FIG. 13 (*b*) are the operation for explaining the bulging effect of the shrink film 220 occurring in the vicinity of the end opening of the shrink film 220.

FIG. 12 (*a*) shows a state in which the edge of the goods 300 is not sufficiently close to the end opening of the shrink film 220 and a little distance remains. As shown in FIG. 12 (*a*), air is blown out from an air blowing port 122 of the head part 121 of the insertion guide body 120, the surrounding shrink film 220 is in a state of being stretched and bulged. However, the head part 121 and the goods suction part 123 having a tapered shape locate at the end opening of the shrink film 220. The gap is larger than that of side surface of the head part 121 and the shrink film 220, so that the air pressure in the vicinity of the end opening of the shrink film 220 tends to decrease. Therefore, there is a possibility that the shrink film 220 is not sufficient in bulging state.

Next, as shown in FIG. 12 (*b*), when the edge of the goods 300 approaches near enough to the end opening of the shrink film 220 by the slider device 130, the area and the space of the air flowing out of the shrink film 220 is reduced. As a result, the air pressure in the vicinity of the end opening of the shrink film 220 increases, and the air pressure to bulge the shrink film 220 rises. The shrink film 220 bulges to secure the state in which the shrink film 220 forms the cylindrical shape. In this state, the inner diameter of the end opening of the shrink film 220 is slightly larger than the outer diameter of the goods 300.

Next, as shown in FIG. 13 (*a*) to (*b*), the goods 300 are pulled by the slider device 130. When the edge of the goods 300 is inserted into the shrink film 220, air stably flows to the space between the shrink film 220 and the goods 300, and the goods 300 can be smoothly inserted.

Figure 10:
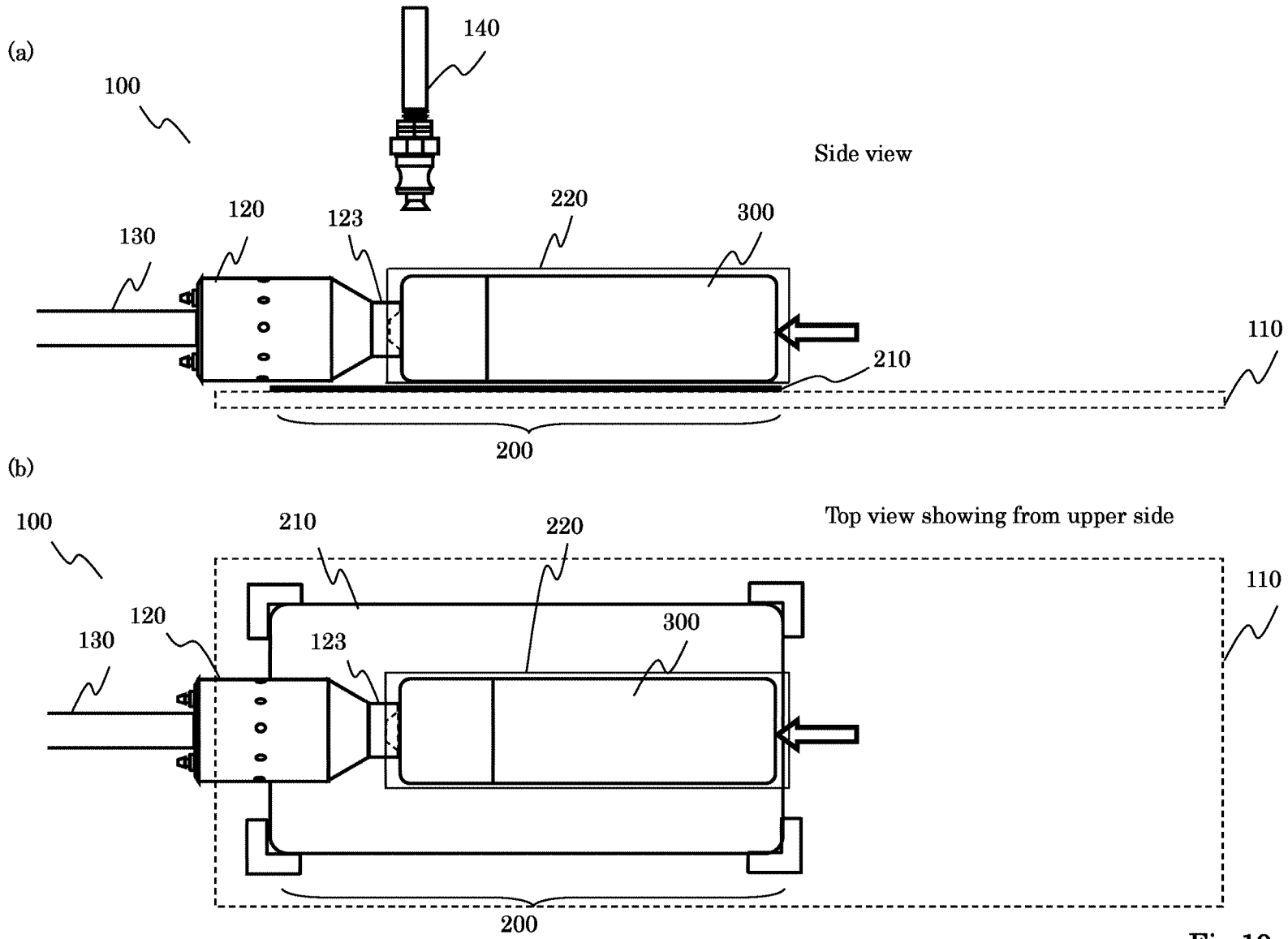
FIG. 10 is a schematic view (part 8) showing the flow of the operation of the automatic insertion device 100 for the mount equipped shrink film package according to the Embodiment 1 of the present invention.

The description is continued with reference to FIG. 10.

FIG. 10 is a schematic view showing how the goods 300 are slid and moved in the shrink film 220 in the inserting operation.

As shown in FIG. 10, during the sliding motion of the insertion guide body 120 in the inserting operation, the goods 300 reach a predetermined position in the shrink film 220. For example, the predetermined position is in the vicinity of the center portion of the shrink film 220.

When the goods 300 reach the predetermined position as shown in FIG. 10, application of negative air pressure via the negative pressure pump connection part 125 is stopped, and then the suction by the goods suction part 123 of the insertion guide body 120 is stopped. The goods 300 are released and are put in the predetermined position of the shrink film 220.

At this state, the execution of the inserting operation is completed.

Figure 11:
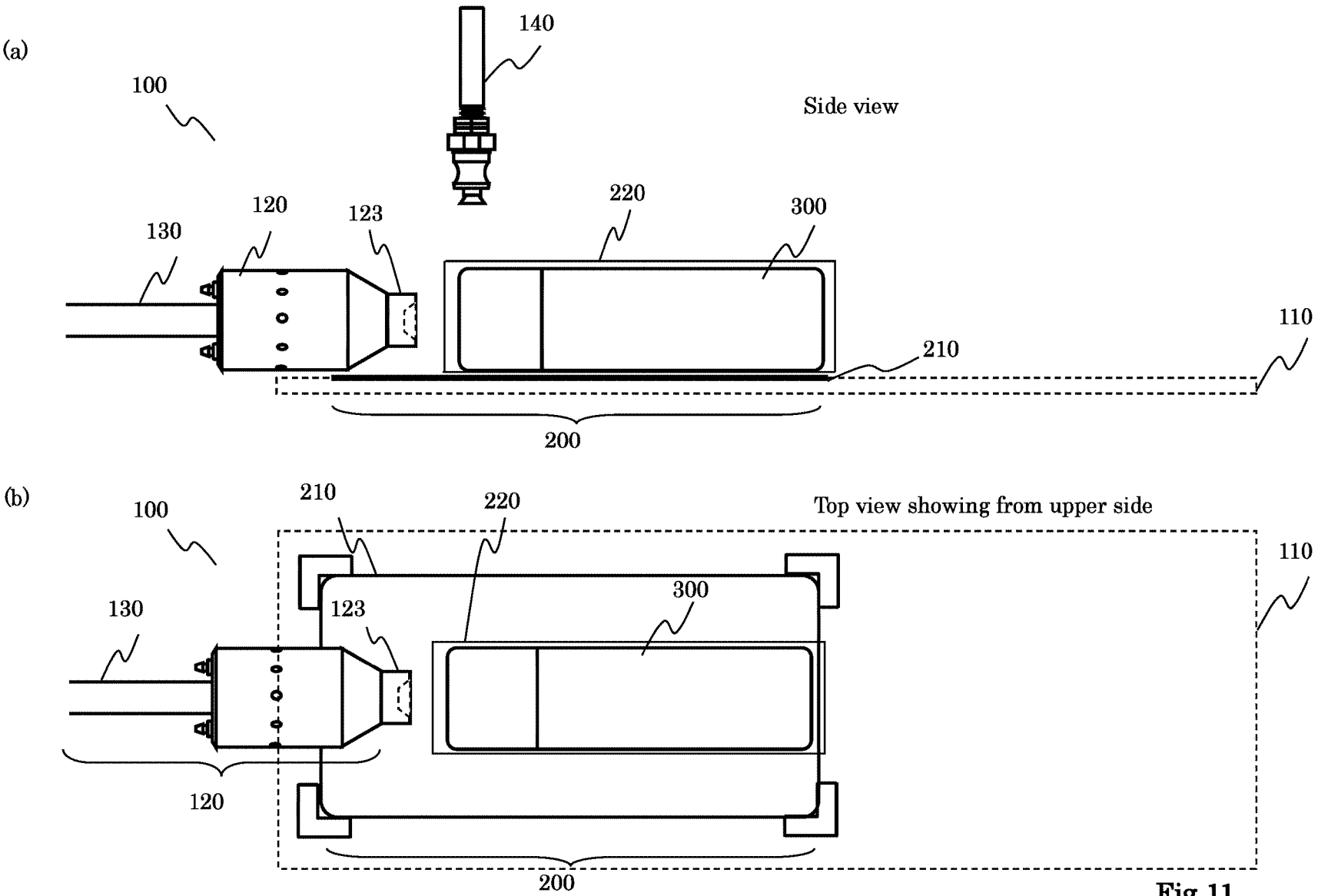
FIG. 11 is a schematic view (part 9) showing the flow of the operation of the automatic insertion device 100 for the mount equipped shrink film package according to the Embodiment 1 of the present invention.

Next, as shown in FIG. 11, when the slide motion of the insertion guide body 120 by the slider device 130 in the inserting operation is completed, the insertion guide body 120 returns to the initial state of the slide stroke shown in FIG. 3. The stroke of the operation is completed.

After that, the currently processed mount equipped shrink film package 200 with the goods 300 is removed from the mounting device 110 and the next stroke is prepared with next mount equipped shrink film package 200 and next goods 300 disposed on the mounting device 110 by the conveyance system (not shown). The automatic insertion device 100 returns to the initial state of the stroke of the operation shown in FIG. 3.

The motion and operation shown in FIG. 3 to FIG. 11 are repeated as the next stroke.

Embodiment 2

As Embodiment 2, an automatic insertion device 100*a* for a mount equipped shrink film package according to the present invention is described. It includes a pushing means for pushing the goods into the shrink film along the inserting direction. The insertion guide is moved by the slider device while the goods is moved by the pushing means. The operation for pushing the goods to the predetermined position in the shrink film by the pushing means is described below.

Regarding the relative motion, the mount equipped shrink film package is fixed, the insertion guide body and goods are moved along the inserting direction in the following description.

Figure 14:
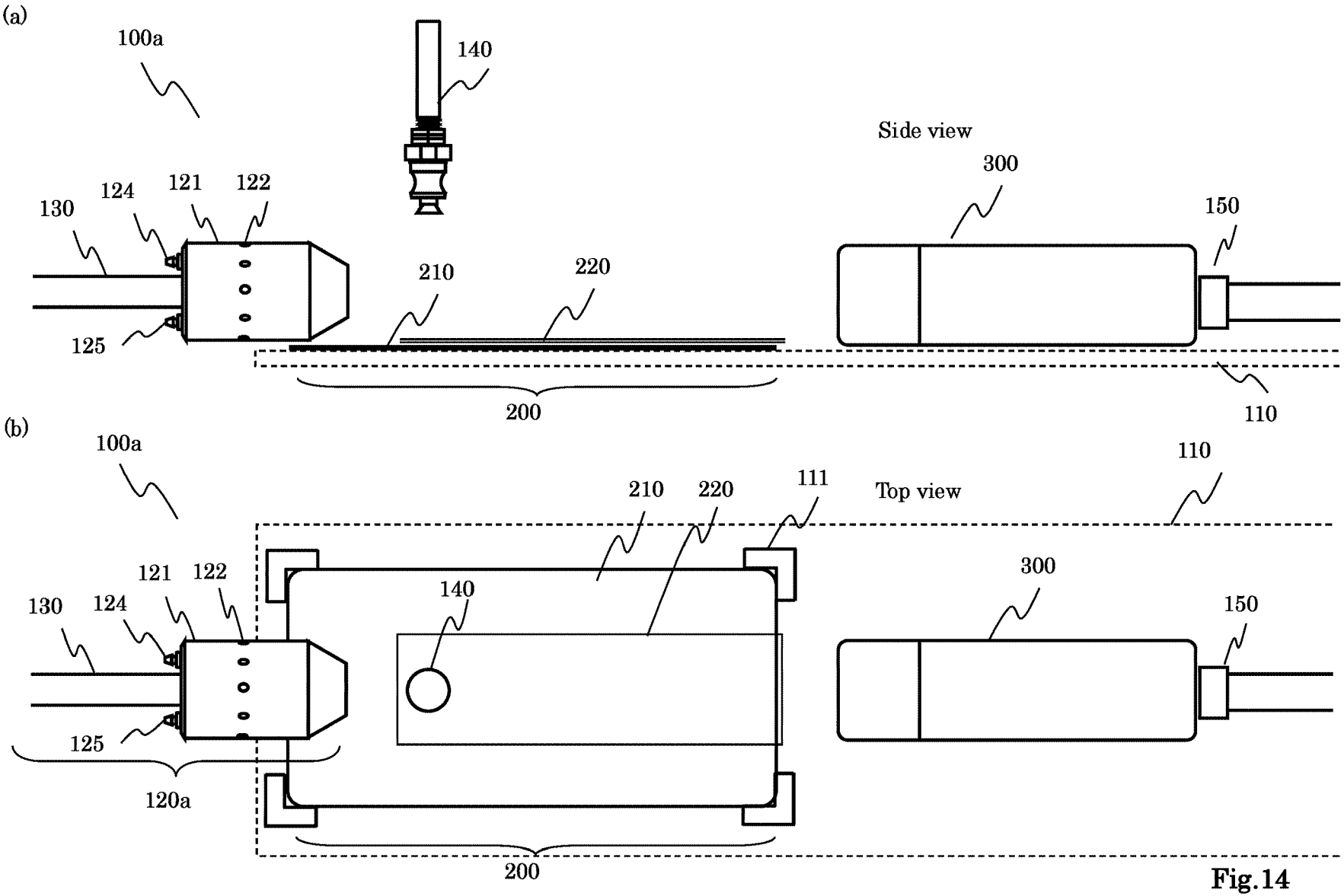
FIG. 14 is a schematic view of an example of the configuration of an automatic insertion device 100*a* for a mount equipped shrink film package according to the Embodiment 2.

FIG. 14 is a schematic view of an example of the configuration of an automatic insertion device 100*a* according to the Embodiment 2.

As shown in FIG. 14, the automatic insertion device 100*a* according to the Embodiment 2 includes a mounting device 110, an insertion guide body 120*a*, a slider device 130, and a shrink film suction part 140, these are the same as the Embodiment 1, and further includes an pushing means 150. In addition, a mount equipped shrink film package 200 and a goods 300 are shown together in FIG. 14.

Hereinafter, the description for the same component as that of the Embodiment 1 is omitted or simplified.

The mounting device 110, the slider device 130, and the shrink film suction part 140 can be the same as those shown in the Embodiment 1, so that the description thereof is omitted here.

The insertion guide body 120*a* has the head part 121, the air discharge port 122, the air pump connection part 124, and the negative pressure pump connection part 125. In this configuration, the goods suction part 123 shown in Embodiment 1 is not provided, but a pushing means 150 is provided behind the goods 300 instead. The head part 121, the air discharge port 122, the air pump connection part 124, and the negative pressure pump connection part 125 of the insertion guide body 120*a* are the same as those shown in Embodiment 1, so the description thereof is omitted here.

The pushing means 150 is an extrusion means for pushing the goods into the shrink film 220 along the inserting direction (from the right to the left in the figure). In this Embodiment 2, the pushing means 150 functions as an inserting means for pushing the goods to be inserted along the inserting direction until they come to a predetermined position in the shrink film 220.

Figure 15:
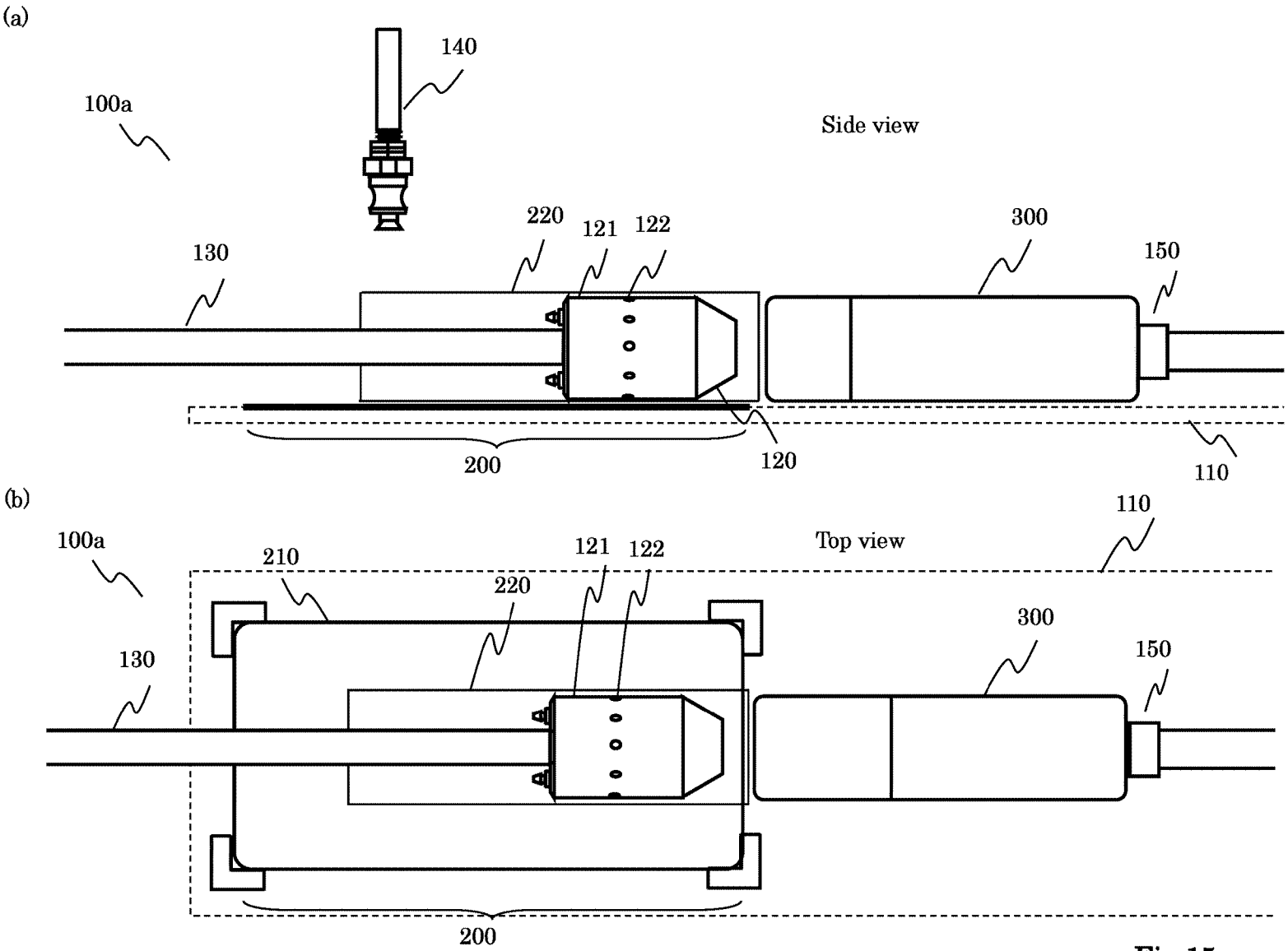
FIG. 15 is a schematic view (part 1) showing the flow of the operation of the automatic insertion device 100*a* for the mount equipped shrink film package according to the Embodiment 2 of the present invention.
Figure 16:
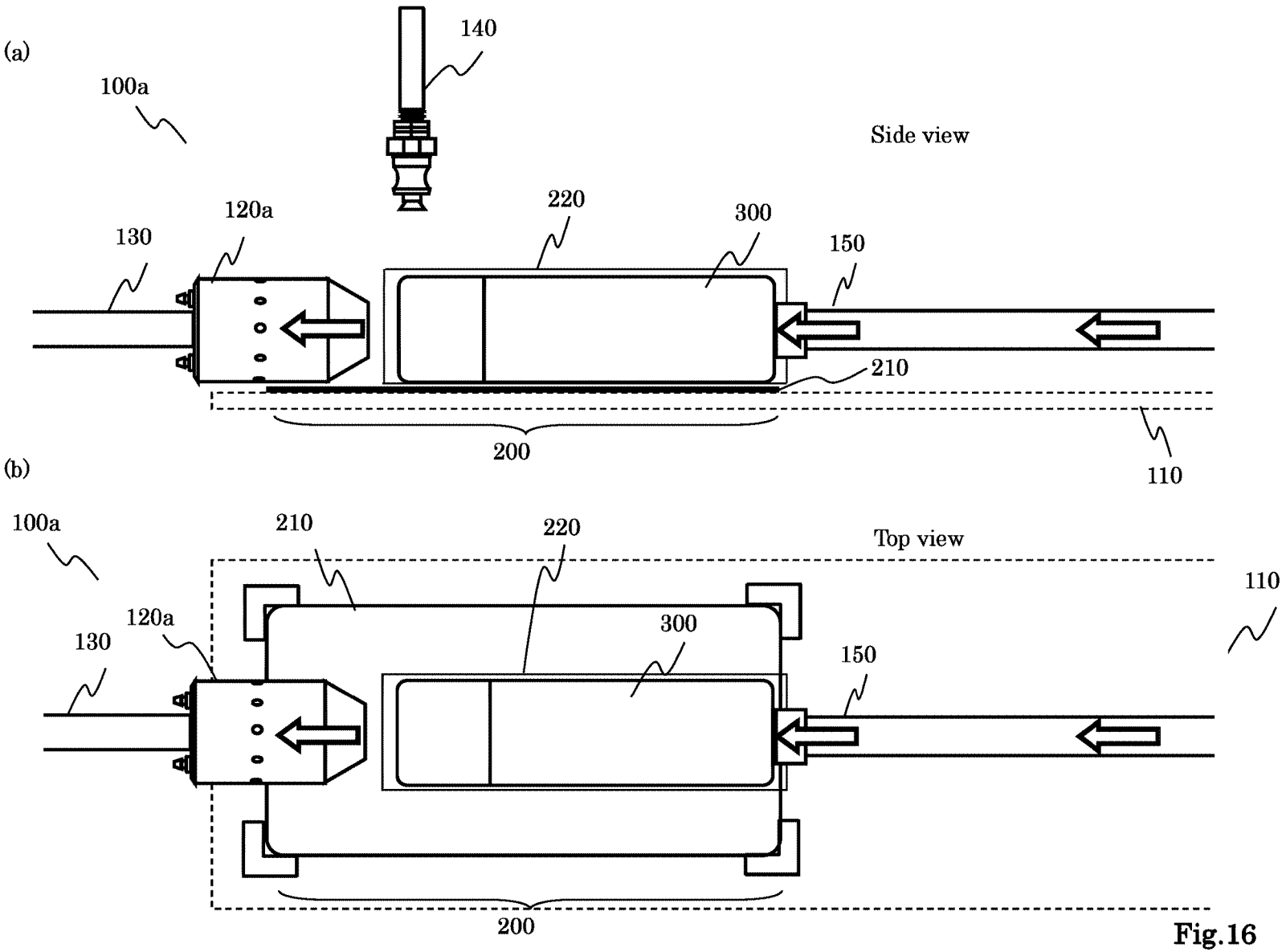
FIG. 16 is a schematic view (part 2) showing the flow of the operation of the automatic insertion device 100*a* for the mount equipped shrink film package according to the Embodiment 2 of the present invention.
Figure 17:
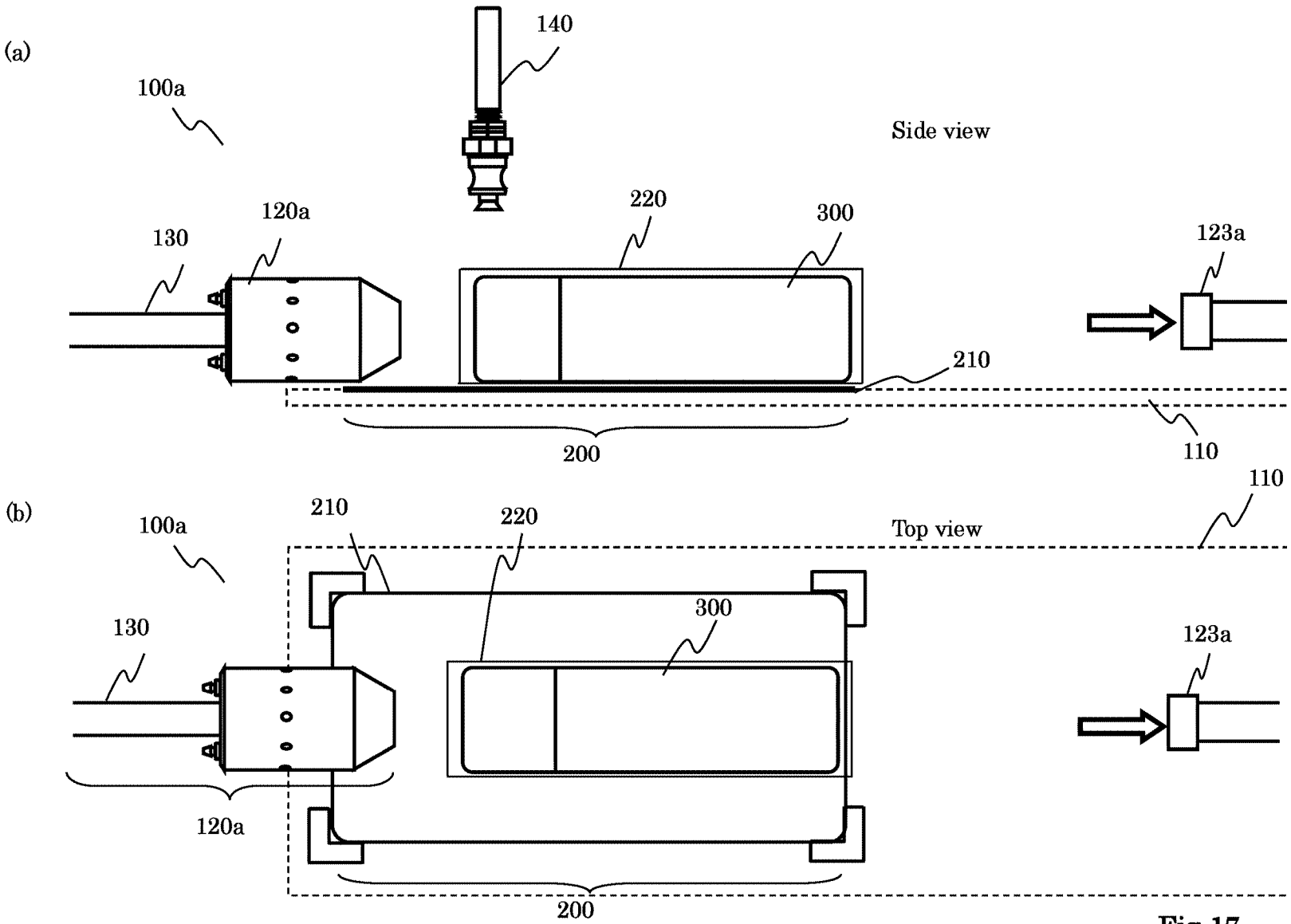
FIG. 17 is a schematic view (part 3) showing the flow of the operation of the automatic insertion device 100*a* for the mount equipped shrink film package according to the Embodiment 2 of the present invention.

Next, a flow of the operation of the automatic insertion device 100*a* for the mount equipped shrink film package according to this Embodiment 2 is described. In FIG. 15 to FIG. 17, drawing (a) shows a side view, and drawing (b) shows a top view from the upper side.

Among flows of the stroke of this Embodiment 2 of the automatic insertion device 100*a*, the flows up to the inserting preparation operation are the same as those shown in FIG. 3 to FIG. 8 in Embodiment 1, so that the illustration and description are omitted here. In the Embodiment 1, the final state of the inserting preparation operation is the state in which the goods suction part 123 contacts with the goods 300 and suctions it. However, in this Embodiment 2, the goods suction part 123 is not provided, so that in the final state of the inserting preparation operation, the edge of the insertion guide body 120*a* is not necessary to contact with the goods 300. FIG. 15 is a schematic view showing the final state of the inserting preparation operation in the stroke of the automatic insertion device 100*a* for the mount equipped shrink film package in this Embodiment 2.

In the state shown in FIG. 15, the air pressure in the shrink film 220 rises due to the air from the air blowing port 122 of the insertion guide body 120*a*, and the inside of the shrink film 220 is in a bulging state.

FIG. 16 is a schematic view showing a state in which the goods 300 are pushed into the shrink film 220 by the pushing means 150 in the inserting operation.

The air pressure in the shrink film 220 rises due to the air from the air blowing port 122 of the insertion guide body 120, and the inside of the shrink film 220 is bulged. From this state, the insertion guide body 120*a* slides to the left side in the figure to get out of the shrink film 220. In synchronization with this insertion guide body 120*a* sliding motion, the goods 300 are pushed into the shrink film 220 by the pushing means 150 as shown in FIG. 16.

In this inserting operation, the goods 300 reach the predetermined position in a shrink film 220. For example, the predetermined position is in the center portion of the shrink film 220.

The execution of the inserting means is completed.

FIG. 17 shows a state in which the pushing means 150 is pulled back to the right side in the figure.

After that, the currently processed mount equipped shrink film package 200 with the goods 300 is removed from the mounting device 110 and the next stroke is prepared as the next mount equipped shrink film package 200 and next goods 300 are disposed on the mounting device 110 by the conveyance system (not shown). The automatic insertion device 100 returns to the initial state of the stroke of the operation shown in FIG. 14.

The motion and operation shown in FIG. 15 to FIG. 17 are repeated as the next stroke.

Embodiment 3

As Embodiment 3, an automatic insertion device 100*b* for a mount equipped shrink film package according to the present invention is described. In this Embodiment 3, the insertion guide body 120 and goods 300 are fixed in relative movement of the inserting operation, and the mount equipped shrink film package 200 is moved to insert the goods to the predetermined position in the shrink film.

Figure 18:
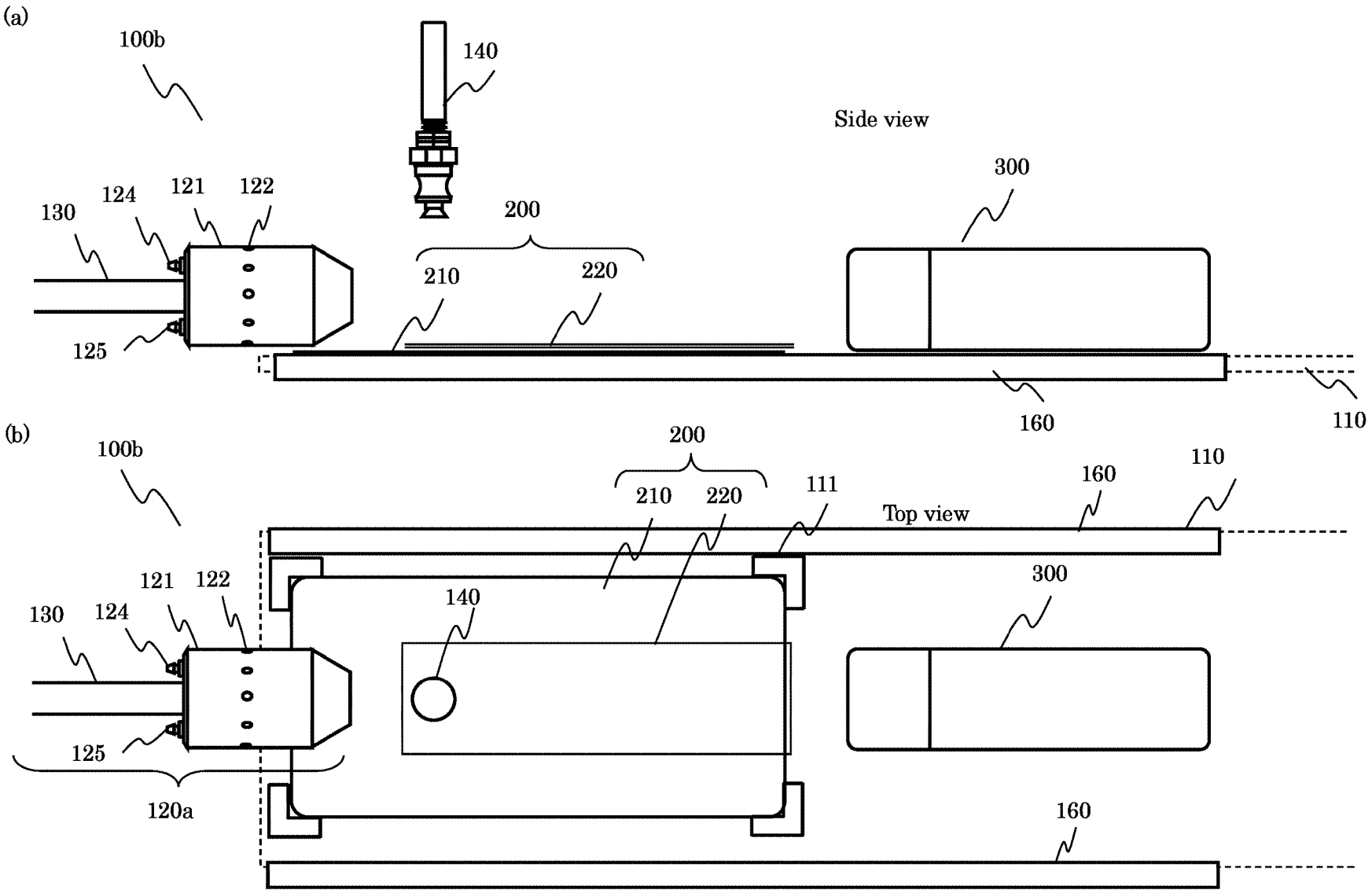
FIG. 18 is a schematic view of an example of the configuration of an automatic insertion device 100*b* for a mount equipped shrink film package according to the Embodiment 3.

FIG. 18 is a schematic view of an example of the configuration of an automatic insertion device 100*b* for a mount equipped shrink film package according to the Embodiment 3.

As shown in FIG. 18, the automatic insertion device 100*b* for a mount equipped shrink film packaging body according to Embodiment 3 includes a mounting device 110, an insertion guide body 120*a*, a slider device 130, and a shrink film suction part 140, these are the same as the Embodiment 1, and further includes a mount equipped shrink film package slider device 160. In addition, a mount equipped shrink film package 200 and a goods 300 are shown together in FIG. 18.

Hereinafter, the description for the same component as that of the Embodiment 1 is omitted or simplified.

The mounting device 110, the slider device 130, and the shrink film suction part 140 can be the same as those shown in the Embodiment 1, so that the description thereof is omitted here.

The insertion guide body 120*a* can be the same as those shown in the Embodiment 2, so that the description thereof is omitted here.

The mount equipped shrink film package slider device 160 is a means for moving the mount equipped shrink film package 200 in a direction opposite to the inserting direction shown in Embodiment 1 and 2 (from the left to the right in the figure). In this Embodiment 3, the mount equipped shrink film package 200 is slid along a direction opposite to the inserting direction shown in the Embodiment 1. The mount equipped shrink film package slider device 160 functions as a means for sliding the mount equipped shrink film package 200 up to the goods inserted to a predetermined position in the shrink film 220.

Figure 19:
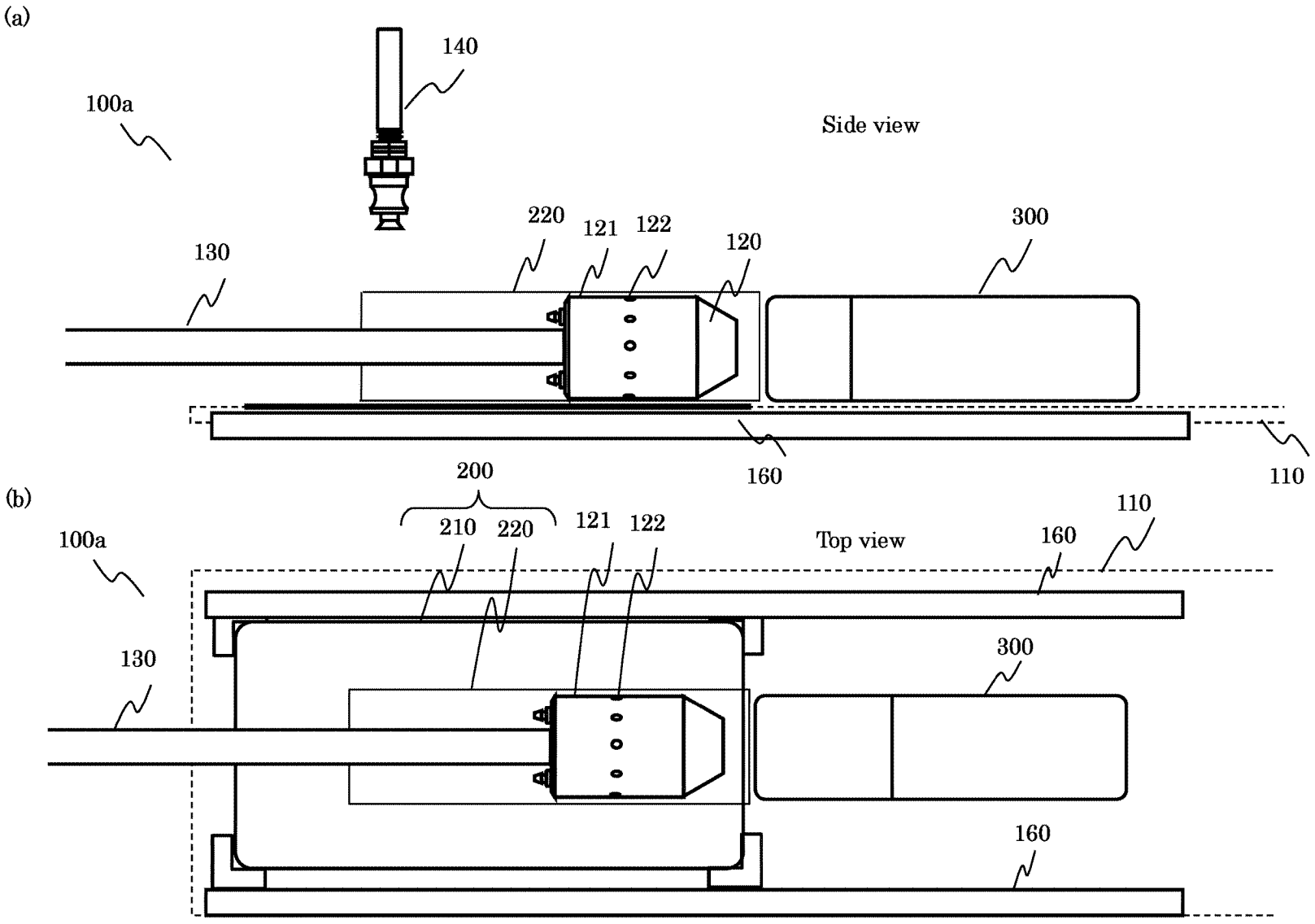
FIG. 19 is a schematic view (part 1) showing the flow of the operation of the automatic insertion device 100*b* for the mount equipped shrink film package according to the Embodiment 3 of the present invention.
Figure 20:
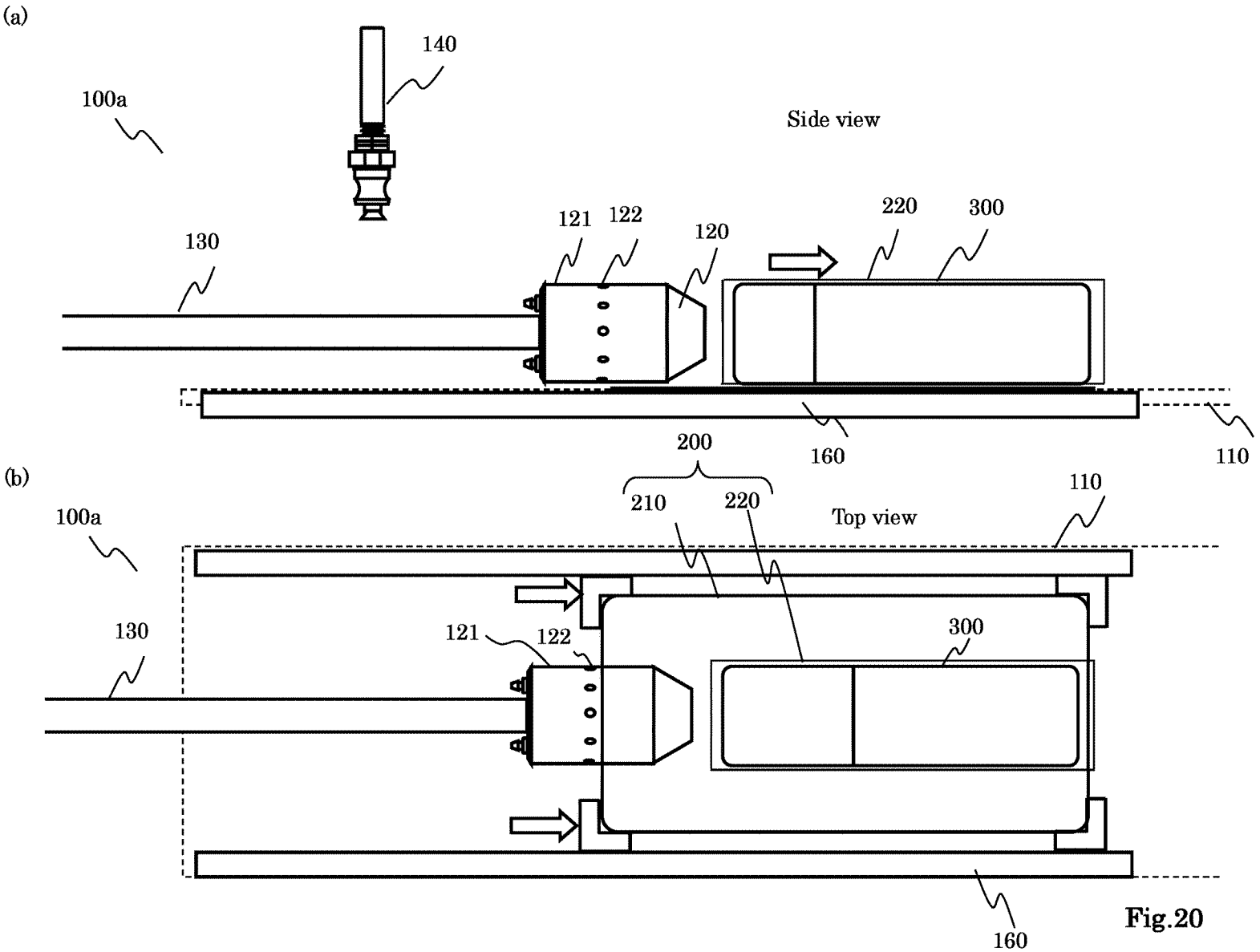
FIG. 20 is a schematic view (part 2) showing the flow of the operation of the automatic insertion device 100*b* for the mount equipped shrink film package according to the Embodiment 3 of the present invention.
Figure 21:
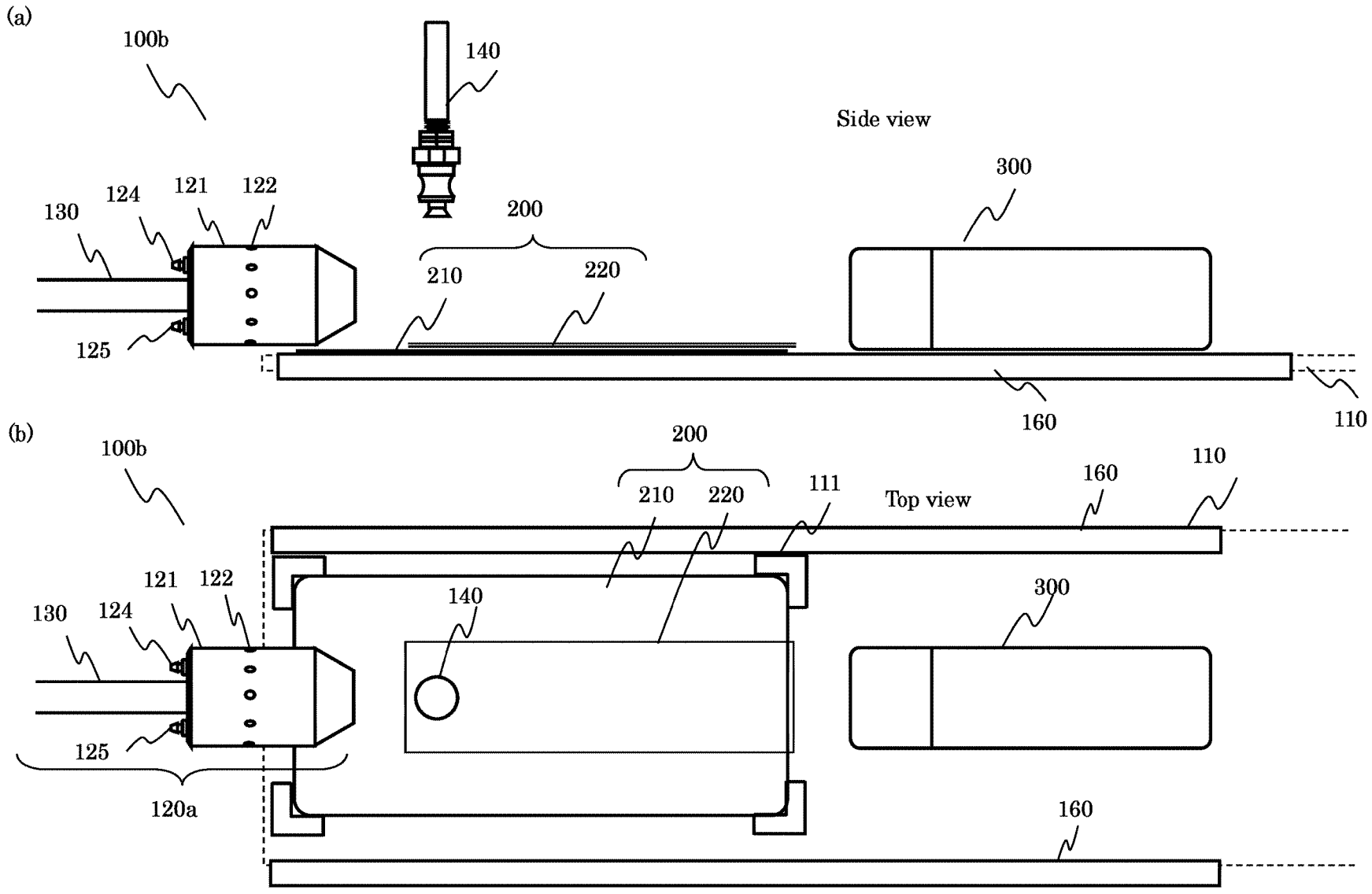
FIG. 21 is a schematic view (part 3) showing the flow of the operation of the automatic insertion device 100*b* for the mount equipped shrink film package according to the Embodiment 3 of the present invention.
Figure 22:
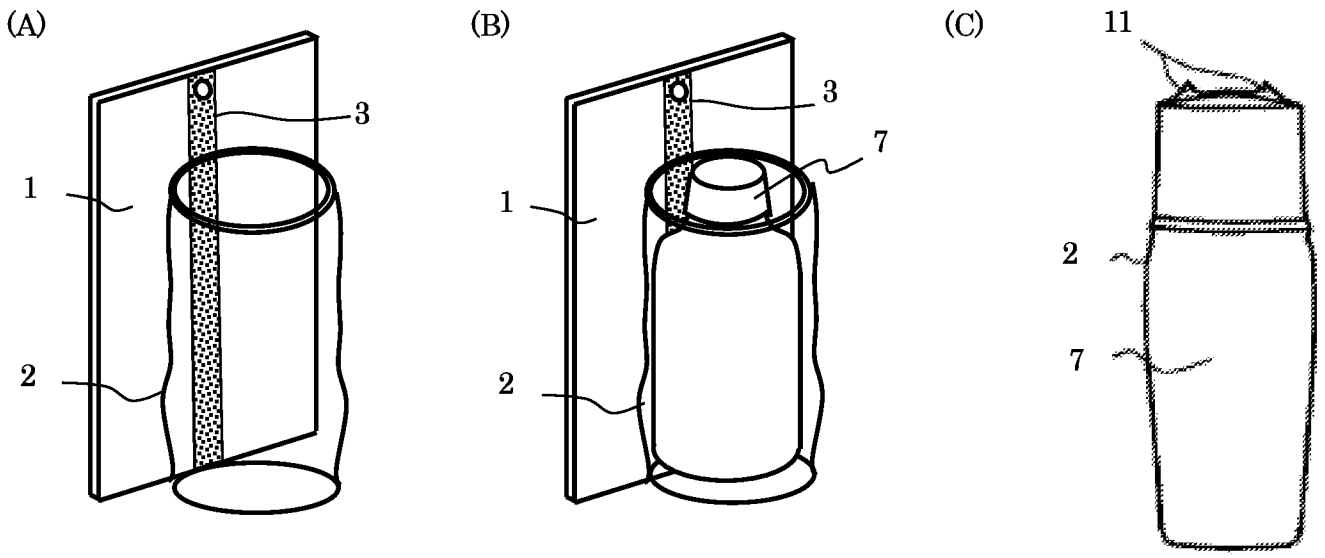
FIG. 22 is a schematic view showing a method for inserting a goods to be inserted to a mount equipped shrink film package disclosed in JP2012-188127 in the prior art (patent document 1).
Figure 23:
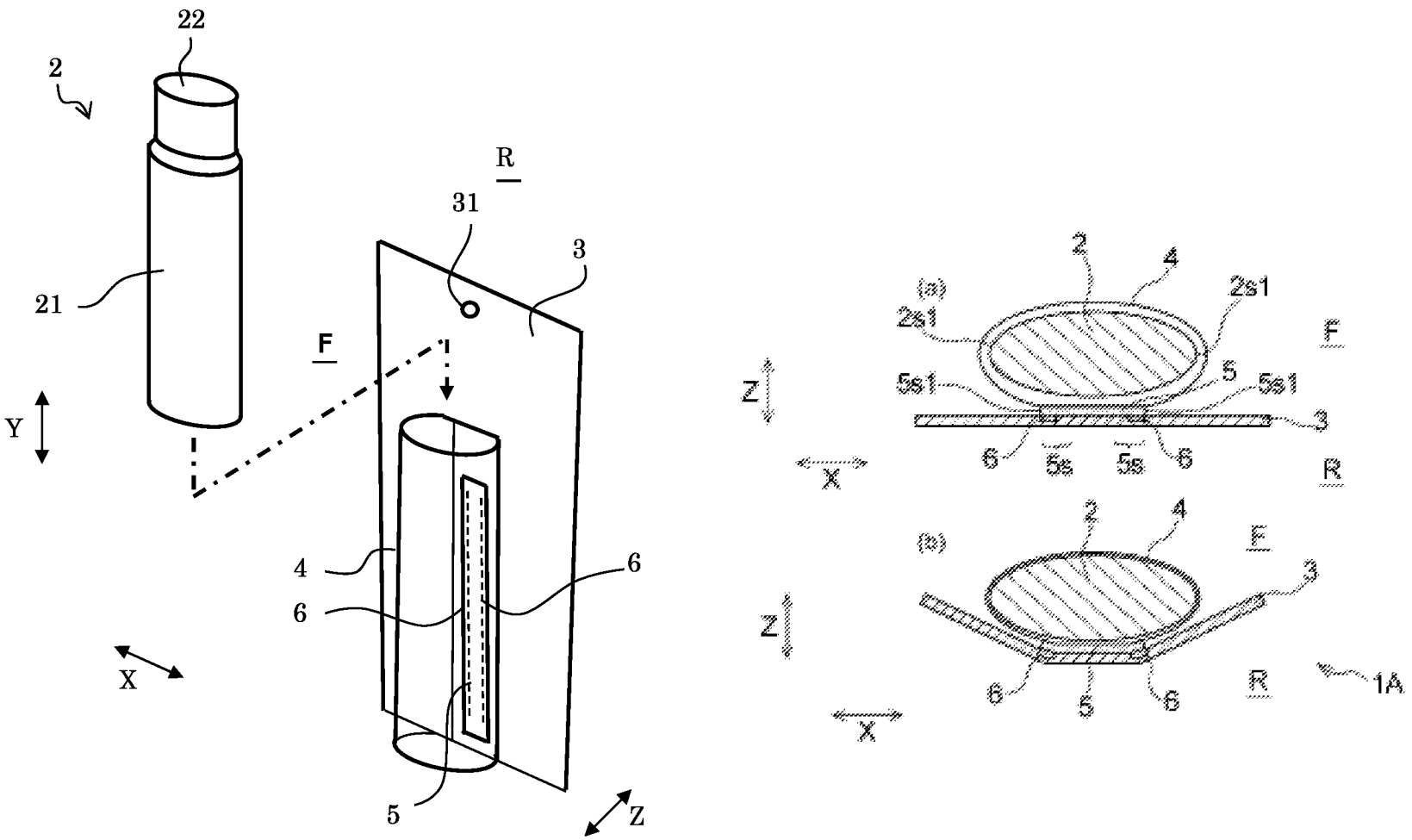
FIG. 23 is a schematic view showing a mount equipped shrink film package disclosed in JP2015-101406 in the prior art (patent document 2).

Hereinafter, a flow of the operation of the automatic insertion device 100*b* for the mount equipped shrink film package according to this Embodiment 3 is described. In FIG. 19 to FIG. 21, drawing (a) shows a side view, and drawing (b) shows a top view from the upper side.

Among flows of the stroke of this Embodiment 3 of the automatic insertion device 100*b*, the flows up to the inserting preparation operation are the same as those shown in FIG. 3 to FIG. 8 in Embodiment 1, so that the illustration and description are omitted here. In the Embodiment 1, the final state of the inserting preparation operation is the state in which the goods suction part 123 contacts with the goods 300 and suctions it. However, in this Embodiment 3, the goods suction part 123 is not provided, so that in the final state of the inserting preparation operation, the edge of the insertion guide body 120*a* is not required to contact with the goods 300.

FIG. 19 is a schematic view showing the final state of the inserting preparation operation in the stroke of the automatic insertion device 100*b* for the mount equipped shrink film package in this Embodiment 3.

In the state shown in FIG. 19, the air pressure in the shrink film 220 rises due to the air from the air blowing port 122 of the insertion guide body 120*a*, and the inside of the shrink film 220 is in bulging state.

FIG. 20 is a schematic view showing a state in which the mount equipped shrink film package 200 slides from left to right in the figure by the mount equipped shrink film package slider device 160 to accept the goods 300 inside. In the inserting operation, the air pressure in the shrink film 220 rises due to the air from the air blowing port 122 of the insertion guide body 120*a*. The mount equipped shrink film package body 200 is slid to the right side in the figure by the shrink film package slider device 160. The insertion guide body 120*a* goes out from the left and the goods 300 comes in from right in the shrink film 220 instead as if replacing the insertion guide body 120*a*.

As shown in FIG. 20, in the inserting operation, the goods 300 reaches the predetermined position in a shrink film 220 by the mount equipped shrink film package slider device 160. For example, a predetermined position is in the center of the shrink film 220.

The execution of the inserting means is completed.

FIG. 21 shows a state in which currently processed mount equipped shrink film package 200 with the goods 300 is removed from the mounting device 110 and the next stroke is prepared with next the mount equipped shrink film package 200 and next goods 300 disposed on the mounting device 110 by the conveyance system (not shown). The automatic insertion device 100*b* returns to the initial state of the stroke of the operation shown in FIG. 18.

The motion and operation shown in FIG. 18 to FIG. 21 are repeated as the next stroke.

While some preferable embodiments of the automatic insertion device and the method for automatic inserting according to the present invention are described above, it should be understood that various changes are possible, without deviating from the technical scope according to the present invention.

INDUSTRIAL APPLICABILITY

An automatic insertion device according to the present invention can be applicable as an automatic insertion device for inserting a goods into a mount equipped shrink film package.

DESCRIPTION OF THE REFERENCE NUMERALS

100 Automatic insertion device
110 Mounting device
120 Insertion guide body
121 Head part
122 Air blowing port
123 Goods suction part
124 Air pump connection part
125 Negative pressure pump connection part
130 Slider device
140 Shrink film suction part
150 Pushing means
160 Mount equipped shrink film package slider device
200 Mount equipped shrink film package
210 Mount
220 Shrink film
300 Goods

We claim:

1. An automatic insertion device for inserting goods into a mount equipped cylinder-shape shrink film package in which an inner diameter of a cylinder-shape shrink film is larger than an outer diameter of the goods, the automatic insertion device comprising:

an insertion guide body including a head part whose outer diameter is smaller than the inner diameter of the cylinder-shape shrink film, and one or more air blowing port or air blowing groove configured to blow air in an outer direction from a surface of the insertion guide body;

a mounting device configured to arrange (i) the insertion guide body, (ii) the mount equipped cylinder-shaped shrink film package and (iii) the goods in series in the order of (i), (ii) and (iii) along an inserting direction;

a slider configured to slide the insertion guide body to the mount equipped cylinder-shape shrink film package where the insertion guide body is arranged facing a first opening of the mount equipped cylinder-shape shrink film package and the goods are arranged facing a second opening of the mount equipped cylinder-shape shrink film package in series;

wherein the insertion guide body is configured to be inserted into the cylinder-shape shrink film while blowing air from a side surface of the head part for bulging the cylinder-shape shrink film on the mount equipped cylinder-shape shrink film package until facing the goods across the second opening, and wherein in an inserting operation, the insertion guide body is configured to pull and move the goods into the mount equipped cylinder-shape shrink film package for inserting the goods into the mount equipped cylinder-shape shrink film package at a predetermined position.

2. An automatic insertion device according to claim 1, wherein the insertion guide body includes a goods suction part on the front edge of its head part that can suction the goods, wherein the insertion device is configured so that, in the inserting preparation operation, the goods suction part first goes through the cylinder-shape shrink film of the mount equipped cylinder-shape shrink film package and attaches the goods facing the second opening of the mount equipped cylinder-shape shrink film package, and suctions the goods, and in the inserting operation, the goods suction part returns to the mount equipped cylinder-shape shrink film package while suctioning the goods as one continuous body.

3. An automatic insertion device according to claim 2, wherein the goods suction part includes an air suction mechanism, and in the inserting operation, the air suction mechanism is activated until the goods are moved to the predetermined position and is deactivated when the goods is moved to the predetermined position to release the goods at the predetermined position.

4. An automatic insertion device according to claim 1, further comprising a goods slider configured to slide the goods to the mount equipped cylinder-shape shrink film package from the second opening of the mount equipped cylinder-shape shrink film package, wherein, in the inserting operation, the goods are moved together with the insertion guide body to the cylinder-shape shrink film of the mount equipped cylinder-shape shrink film package, wherein motions of both the slider and the goods slider are synchronized for pushing the goods up to the predetermined position of the cylinder-shape shrink film of the mount equipped cylinder-shape shrink film package.

5. An automatic insertion device according to claim 1, wherein the distance between the cylinder-shape shrink film of the mount equipped cylinder-shape shrink film package and the goods arranged in series on the mounting device is narrower than the length of the head part of the insertion guide body.

6. An automatic insertion device according to claim 1, wherein the outer diameter of the insertion guide body decreases toward the head.

7. An automatic insertion device according to claim 1, further comprising a shrink film suction part configured to suction an upper surface of the cylinder-shape shrink film for opening the first opening of the cylinder-shape shrink film and keeping the first opening open by air suction in the inserting operation.

8. An automatic insertion method for inserting goods into a mount equipped cylinder-shape shrink film package in which an inner diameter of a shrink film is larger than an outer diameter of the goods, the automatic insertion method using a device comprising:

an insertion guide body including a head part whose outer diameter is smaller than the inner diameter of the shrink film, and one or more air blowing port or air blowing groove configured to blow air to outer direction from a surface of the insertion guide body; and a slider configured to slide the insertion guide body to the mount equipped cylinder-shape shrink film package, wherein the insertion guide body is arranged facing a first opening of the mount equipped cylinder-shape shrink film package, and the goods is arranged facing a second opening of the mount equipped cylinder-shape shrink film package in series in an order of (i) the insertion guide body, (ii) the mount equipped cylinder-shape shrink film package, and (iii) the goods, the automatic insertion method comprising:

arranging (i) the insertion guide body, (ii) the mount equipped cylinder-shape shrink film package, and (iii) the goods in series in the order of (i), (ii) and (iii) along an inserting direction;

executing an inserting preparation operation in which the insertion guide body is inserted into the shrink film with blowing air from a side surface of the head part for bulging the shrink film on the mount equipped cylinder-shape shrink film package up to facing the goods across the second opening; and executing an inserting operation in which the insertion guide body with the goods is across the second opening and moved to the mount equipped cylinder-shape shrink film package for inserting the goods into the mount equipped cylinder-shape shrink film package up to a predetermined position.

9. An automatic insertion device for inserting goods into a mount equipped cylinder-shape shrink film package in which an inner diameter of a shrink film is larger than an outer diameter of the goods, the automatic insertion device comprising:

an insertion guide body including a head part whose outer diameter is smaller than the inner diameter of the shrink film, and one or more air blowing port or air blowing groove for blowing air to outer direction from a surface of the insertion guide body;

a mounting device configured to arrange (i) the insertion guide body, (ii) the mount equipped cylinder-shaped shrink film package and (iii) the goods in series in the above shown order of (i), (ii) and (iii) along an inserting direction;

a slider configured to slide the mount equipped cylinder-shape shrink film package to the insertion guide body where the insertion guide body is arranged facing a first opening of the mount equipped cylinder-shape shrink film package and the goods are arranged facing a second opening of the mount equipped cylinder-shape shrink film package in series wherein the insertion guide body is inserted into the shrink film with blowing air from a side surface of the head part for bulging the shrink film on the mount equipped cylinder-shape shrink film package until facing the goods, and wherein the mount equipped cylinder-shape shrink film package is moved to the goods for inserting the goods into the mount equipped cylinder-shape shrink film package at a predetermined position.

* * * * *